US009170074B2

(12) United States Patent
Beckman

(10) Patent No.: US 9,170,074 B2
(45) Date of Patent: Oct. 27, 2015

(54) PROJECTILE INTERCEPTOR MOUNTABLE ON A FIREARM

(71) Applicant: Christopher V. Beckman, San Diego, CA (US)

(72) Inventor: Christopher V. Beckman, San Diego, CA (US)

( * ) Notice: Subject to any disclaimer, the term of this patent is extended or adjusted under 35 U.S.C. 154(b) by 0 days.

(21) Appl. No.: 14/515,486

(22) Filed: Oct. 15, 2014

(65) Prior Publication Data

US 2015/0219425 A1 Aug. 6, 2015

Related U.S. Application Data

(63) Continuation-in-part of application No. 13/656,707, filed on Oct. 20, 2012, now Pat. No. 8,875,433.

(51) Int. Cl.
*F41C 27/00* (2006.01)
*F41H 11/00* (2006.01)
*F41A 35/00* (2006.01)

(52) U.S. Cl.
CPC ..... *F41H 11/00* (2013.01); *F41A 35/00* (2013.01)

(58) Field of Classification Search
USPC ..... 42/90, 106; 89/41.01, 41.08, 41.17, 89/1.11, 1.1
See application file for complete search history.

(56) References Cited

U.S. PATENT DOCUMENTS 6,178,141 B1 * 1/2001 Duckworth et al. ..... 367/127
2003/0126978 A1 * 7/2003 Rastegar ..... 89/1.11
2012/0312149 A1 * 12/2012 Marscher et al. ..... 89/1.11
2013/0125656 A1 * 5/2013 Tillotson et al. ..... 73/599
2013/0268183 A1 * 10/2013 Yamamoto et al. ..... 701/120
2013/0311078 A1 * 11/2013 Ding et al. ..... 701/302
2014/0251123 A1 * 9/2014 Venema ..... 89/41.22

OTHER PUBLICATIONS

Stone, G. C., A Glossary of the Construction, Decoration and Use of Arms & Armor in All Countries and in All Times. Mineola, NY, Dover Publications, Inc., 1999. p. 22 and Fig. 82.
Garamone, J., Body Armor Works, Army Acquisition Official Says DoD News (Aug. 18, 2011), available at http://www.defense.gov/news/newsarticle.aspx?id=65076, accessed Oct. 10, 2014, retrieved on Oct. 17, 2014; 2 pages.
Insinna, V., Northrop Grumman Pitching New Humvee Chassis to Army National Defense (Oct. 7, 2014), available at http://www.nationaldefensemagazine.org/blog/Lists/Posts/Post.aspx?ID=1633, accessed Oct. 10, 2014, retrieved on Oct. 17, 2014; 3 pages.
Lynn III, W.J., Directive No. 5240.06 Department of Defense, (May 17, 2011), "Counterintelligence" definition, abbreviation "CI," p. 18.
Moreno, J.A., NATO Glossary of Terms and Definitions, AAP-6 North Atlantic Treaty Organization (2008), entry for "suppression fire," p. 2-S-15.

* cited by examiner

*Primary Examiner* — J. Woodrow Eldred

(57) ABSTRACT

Ballistic projectile protection devices, and methods for their use, are provided. In a preferred embodiment, a gun-mounted ballistic protection device is provided, comprising multiple interception media launchers that cover and protect a user's vital organs from incoming projectiles. In some aspects of the invention, a control system using a microphone or other sensors, with multiple sampling points in a forward location, determine the location and trajectory of an incoming projectile, and deploy interception media to intercept the incoming projectile. In a preferred embodiment, a user may activate the projectile protection device with a partial trigger pull, or a button placed within reach of a user's trigger finger.

16 Claims, 16 Drawing Sheets

PROJECTILE INTERCEPTOR MOUNTABLE ON A FIREARM

RELATED APPLICATION DATA

This application is a continuation-in-part of co-pending U.S. patent application Ser. No. 13/656,707, filed Oct. 20, 2012, the entire contents of which are hereby incorporated herein by reference in their entirety into the present application.

FIELD OF THE INVENTION

The present invention relates to the field of firearms and ballistic protection equipment.

BACKGROUND

The inventive subject matter disclosed in this application, including applications incorporated by reference herein, relates to several technical fields, including firearm ammunition magazines, ballistic protection, tactical strategy, and counterintelligence devices.

In modern automatic and semi-automatic firearms, reloading is frequently accomplished by an ammunition storing and deploying component known as an ammunition magazine ("magazine"), which stores ammunition cartridges that may be serially fed into the firearm chamber for firing. In some firearms, magazines are fixed to the firearm, meaning that they are not designed to be removed and replaced with other magazines rapidly by a standard user operation during use of the firearm, and/or without separate tools. Some firearms implement detachable magazines, which, by contrast, may be removed and replaced during firearm use by a standard user operation during use of the firearm, without separate tools.

Firearms used in combat and other situations with potentially heavy crossfire often incorporate detachable magazines, because the serial reloading of cartridges into a fixed magazine would require too much time during use of the firearm and jeopardize the safety of the user. In such situations, a user may carry several fully loaded, detached magazines to rapidly, fully reload the firearm during engagement. Firearms using fixed magazines are better adapted to sporting or remote use (such as hunting or sniping), but even in those contexts, a detachable exchangeable magazine firearm is often used.

Both detachable and fixed magazines are typically rectangular or curved (in the instance of "banana" style clips) boxes, incorporating a spring that applies force to a movable piece called a "follower" attached to the spring, for feeding cartridges into a firing chamber, seriatim, from a magazine port, which typically has a lip (or lips) partially closing it for the retention of the cartridges until they are fed into the firing chamber. A bolt or other feeding and/or firing mechanism action may enter an open part of the port to catch an edge of, and push, a cartridge through another more open part of the port, sliding it out of the magazine and into the firing chamber (after removing a shell casing from the firing chamber, if necessary). But magazines may take a wide variety of other forms, including cylindrical shapes, without springs and followers. See, e.g., U.S. Pat. No. 6,502,495. Typically, when a magazine has been emptied by use of the firearm, a last, remaining bullet may still occupy the firing chamber, until it is fired. In some magazine systems, firing that final cartridge will result in the bolt and/or action being "locked open" to signify that the magazine is empty and requires reloading or replacement. See id.; see also U.S. Pat. No. 708,794, to Browning (patent for the Colt Model 1902, which included last shot hold-open) (claim 3).

In some magazine systems, the magazine may at least roughly indicate the amount of ammunition remaining loaded in a magazine, for instance, by a "window" or other indicator of the degree to which the magazine is filled with ammunition or the degree to which the follower and/or spring have risen in the magazine due to the removal of ammunition. See, e.g., Product Literature re: CAA Tactical's Mag 17, available at http://www.caatactical.com/viewProduct.asp?ID=351&catID=318, accessed Sep. 17, 2012.

A wide variety of magazine stowing and deployment easing solutions have also been invented, such as belts, pockets, holsters and grips. Such systems may aid soldiers and other firearms users in accessing and replacing magazines. See, e.g., U.S. Pat. No. 6,481,136.

Armor has been used in warfare since the dawn of civilization, beginning with the use of animal hides, as demonstrated by some early artifacts recovered in the Philippines. See generally Stone, G. C., A Glossary of the Construction, Decoration and Use of Arms & Armor in All Countries and at All Times, at p. 22 and FIG. 82. In the copper, bronze and iron ages, metal armor plating was initiated, providing far greater protection against increasingly deadly weapons. In modern warfare, metal, ceramic and other armor plates are still used extensively in body armor, vehicles and stationary barriers. Body armor is standard issue for United States soldiers, and includes the use of protective plates to defeat small arms ammunition. See, e.g., Garamone, J., Body Armor Works, available at http://www.defense.gov/news/newsarticle.aspx?id=65076, accessed Oct. 10, 2014. Armored vehicles and barriers can be outfitted for protection against such small arms, and against larger-impact explosive weapons and projectiles, such as roadside bombs and IEDs. Insinna, V., National Defense, available at http://www.nationaldefensemagazine.org/blog/Lists/Posts/Post.aspx?ID=1633, accessed Oct. 10, 2014.

The field of counterintelligence relates to efforts to defeat and control an enemy's intelligence activities. The form of enemy intelligence subject to the inventive subject matter in this application relates specifically to troop positions, armament and firing sources. With respect to the latter point, the present application also relates to creating suppressive fire.

It should be understood that the disclosures in this application related to the background of the invention in, but not limited to, this section (titled "Background") are to aid readers in comprehending the invention, and are not necessarily prior art or other publicly known aspects affecting the application; instead the disclosures in this application related to the background of the invention may comprise details of the inventor's own discoveries, work and work results, including aspects of the present invention. Nothing in the disclosures related to the background of the invention is or should be construed as an admission related to prior art or the work of others prior to the conception or reduction to practice of the present invention.

Summary of the Inventive Subject Matter

The inventive subject matter set forth in the present application involves (1) techniques for rapid, partial and supplemental reloading of firearms using multiple magazines; (2) the protection of firearm users from incoming projectiles using a firearm-mountable protection device that launches and interception media; and (3) gunfire decoy devices, for creating suppressive fire in locations away from a soldier.

With respect to subject 1, above, the present application discloses techniques for rapid, flexible, partial and supplemental reloading of firearms using new, specialized actions, intermediate storage devices, cartridge feeding systems and/or magazines, which may be multiple, simultaneously engaged magazines. The techniques disclosed include multiple-magazine, multiple compartment and/or multiple feed systems, that allow a firearm to be flexibly and/or partially reloaded, load-completed, and loaded and firing-ready with multiple loaded cartridges at all times, provided enough ammunition magazines are on hand—even during a reloading operation. The invention also includes other techniques for flexible, non-wasteful partially-empty reloading or load completion, including an automatic magazine selector, ejector and ammunition counter and communication system, to aid in optimizing the use of aspects of the invention.

Among other objects, the embodiments of the invention eliminate and/or substantially reduce reloading paralysis, and allow a soldier or other user, not the size of a magazine, to better determine when, if, how often and how much firing will pause and continue.

With respect to subject 2, above, the present application discloses projectile protection devices, and methods for their use. In a preferred embodiment, a gun-mounted ballistic protection device is provided, comprising multiple interception media launchers that covering and protecting a user's vital organs from incoming projectiles. In some aspects of the invention, a control system using a microphone or other sensors with multiple sampling points in a forward location, determine the location and trajectory of an incoming projectile, and deploy the interception media to intercept the incoming projectile. In another preferred embodiment, a user may activate the projectile protection device with a partial trigger pull, or a button placed within reach of a user's trigger finger.

With respect to subject 3, above, the present application discloses several gunfire decoy devices. In a preferred embodiment, a pin-pull device may be used to program and adjust several settings of the decoy devices, serving to activate such devices immediately before deployment. In some aspects, the pin-pull device, once withdrawn, may also serve as a remote control unit, allowing for additional adjustments and control of the devices after deployment. In a preferred method of deployment, the devices are thrown to a location different from that occupied by the user(s), simulating a source of gunfire different from the user(s), distracting and misleading an enemy, and/or providing the effects of cover or other suppressive fire.

It should be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

DETAILED DESCRIPTION OF THE INVENTION

Figure 1:
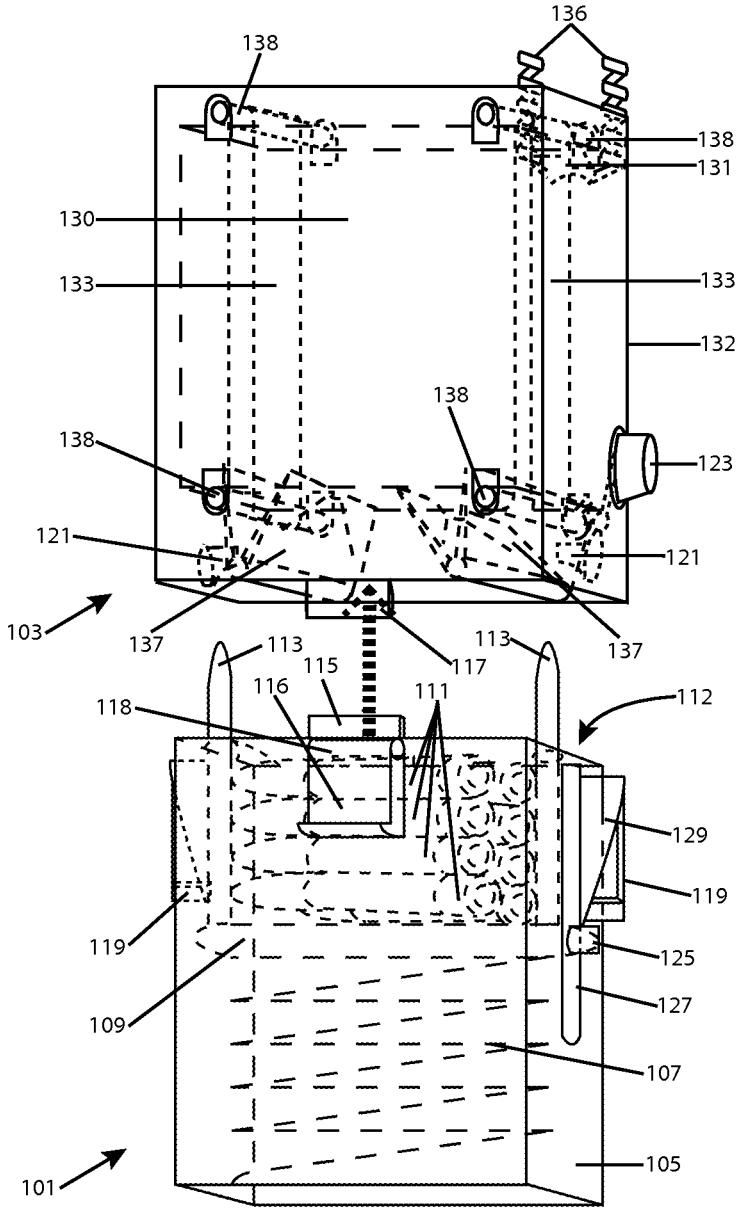
FIG. 1 is a perspective illustration of aspects of a flexible-loading ammunition system, including an ammunition magazine and a pre-firing cartridge feed and storage antechamber, in accordance with aspects of the present invention.

FIG. 1 is a perspective illustration of aspects of a flexible-loading ammunition system, including an ammunition magazine 101 and a pre-firing cartridge feed and storage antechamber 103, in accordance with aspects of the present invention.

The magazine 101 comprises an approximately 5-sided-box-shaped and an at least semi-rigid outer housing structure 105. However, components of magazine 101, such as housing structure 105, may comprise any suitable material(s), shapes or configurations for ammunition magazines. A force-loading mechanism (such as a spring) 107 applies force to a follower 109, which, in turn, holds and applies upward force on loaded firearm cartridges, such as those examples pictured as 111, toward the at least partially open top-end 112 of the magazine 101. Attached to, against or in communication with follower 109 are pressure-exerting, raisable/descendible posts 113. A spreadable/contractable cartridge-securing tab (or tabs), such as 115, retain cartridges loaded in the magazine 101, unless and until magazine 101 is itself loaded into antechamber 103, in which case, as discussed in greater detail, below, the tab or tabs are spread open by the loading action.

Securing tab(s) 115 allow cartridges to be loaded straight-down into magazine 101, which is faster than the 2- or 3-step push-and-slide loading action of most magazines, because tab(s) 115 hold a top cartridge evenly, at the lengthwise center of the spring- and follower-exerted force, rather than from the rear end of the casing as in conventional magazine lips. In some embodiments, during loading, a user may use a handle 116 of tab(s) 115 to aid in clearing the loading-, otherwise open-top-end of disengaged magazine 101. In the figure, the handle 116 is shown pressed against the outer housing of the magazine 101, leading tab 115 to pivot upward, clearing the opening for loading/unloading of cartridges. But, force-biasing of the pivot point or hinge 118 would otherwise cause clockwise rotation of the tab, at least until sufficiently closing port 112 to hold cartridges in the magazine. Also, preferably, no such exposed tab actuator handle aspect is accessible to the user and, when loading, a user simply forces a cartridge past the tab, for example, by a one-way stop shape and outward compressibility of the tab(s), or other flexible release in the direction of loading, which does not allow the tab(s) 115 to release cartridges toward the top-end 112, unless and until the magazine itself has been loaded into and fully engaged and seated with antechamber 103, which clears the tab(s) from the unloading passage of cartridges via an internal tab-clearer 117, which may be sloped to lead to pressing the tab(s) or rotating it out of the way of the port, such that it/they may permit the passage of cartridges. Although it may provide some loading convenience, the lack of an exterior handle 116 is preferred, especially in combat settings, because it may be inadvertently actuated in combat, causing the unintended emptying of the magazine 101.

Upon loading magazine 101 with cartridges, such as those pictured as 111, and which are held in place by tabs 115, the magazine may itself be loaded into an intermediate storage and advancement antechamber 103, via the engagement of complementary loading external magazine catch(es) 119 and internal antechamber catch(es) 121. When properly so locked in place and mounted, and functioning properly, the magazine 101 may be considered properly engaged with both the antechamber and the firearm. A button release, such as that pictured as 123, may allow a user to disengage and release the magazine, after it is properly engaged. But preferably, upon fully unloading, a rising tab 125 in an outer housing channel 127 also automatically depresses catch 119, gravitationally releasing magazine 101, by engaging a ramp 129 attached to or part of catch 119 as the tab 125 rises. In order to rise along with unloading of the magazine 101, tab 125 is preferably attached to follower 109, and extends outside housing 105 through channel 127.

Once loaded into antechamber 103, magazine 101 is opened by tab clearer(s) 117, and may unload a cartridge or cartridges into a cartridge-holding section 130 of antechamber 103, if, and only if, holding section 130 is not already maximally filled with cartridges, which would then exert pressure against cartridges within the magazine, retaining them there despite their upward forcing by force-biasing 107 and follower 109. Preferably, antechamber 103 is an integral part of a firearm, feeding cartridges into a firing chamber (not pictured) from the top-end of the antechamber. However, in some embodiments, both antechamber 103 and magazines such as 101 may be retrofitted onto, or used as a temporary attachment to, existing firearms, in place of an ordinary magazine. In the latter case, the structural features (e.g., magazine release and attachment features, insertion shape, etc.) would be modified from that pictured, to suit the magazine-loading requirements of each such existing firearm. Even if antechamber 103 were fully loaded when magazine 101 properly engaged with antechamber 103, magazine 101 would begin to feed cartridges into antechamber 103 as cartridges are emptied from the antechamber by firing or other bolt action, which clears space for more cartridges in the antechamber. At such time, spring 107 and follower 109 are no longer pushing cartridges against filled space in the antechamber, and, as a result, may shove cartridges into it.

As magazine 101 so unloads its cartridges into antechamber 103, force-exerting posts 113 may rise with follower 109, to which they may be attached, and, as a result, may engage with and apply upward force against post holders 131, within antechamber 103. Post holders 131 are attached to the outer-side (facing the inner-side of housing 132) of belts 133 within antechamber 103, which belts wrap around, and may advance along, belt-advancing rollers 138, which may be mounted in, and rotate within, housing 132. Also attached to the holders, belts and/or rollers are advancing spring(s) 136 (or other such force biasing) which apply downward force, counter to, but insufficient to overcome, the force exerted by posts 113 against holders 131. As a result, the upward force of rising posts 113 may cause post holders 131 to rise and the left- and right-hand-side (from the perspective of the figure) belts 133 to rotate clockwise and counterclockwise respectively. The inward sides of each belt, in turn, are attached to risable one-way bottom-defining members 137 of the antechamber holding section 130. Such bottom-defining members 137 may be flexible and one-way sloped and channeled, and allow cartridges to be loaded into section 130, but they do not allow cartridges to exit in the direction that they were loaded in the event that magazine 101 is detached, for example, because a magazine such as 101 has been emptied and disengaged and/or the user elected additional loading prior to empty of either the magazine 101 and/or antechamber 103. And even if magazine 101 is detached from antechamber 103, and no cartridge loading or advancing force is therefore exerted by spring 107, springs 136 serve to advance cartridges remaining in antechamber 103, allowing continued firing even before new magazines, such as 101 are fetched and loaded.

It should be understood that the particular embodiments set forth in this figure, and elsewhere in this application, are exemplary only, and that aspects of the invention may be carried out with a wide variety of alternative particular shapes, materials, configurations, orders and sequences than that particularly described, and still fall within the scope of the invention. Nothing in the description should be construed as a disclaimer or removal of such alternatives.

Figure 2:
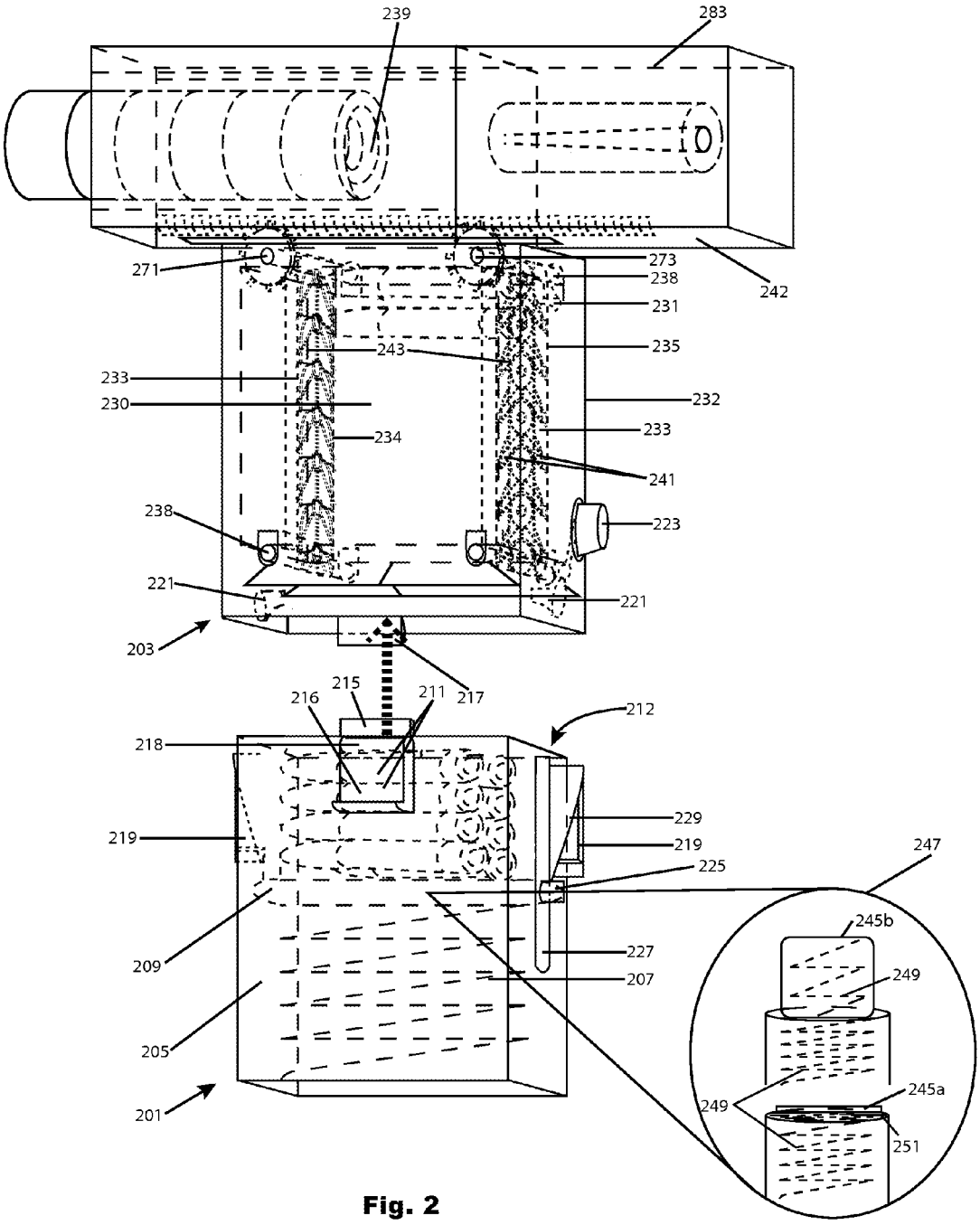
FIG. 2 is a perspective illustration of another flexible-loading ammunition system, including, but not limited to, other embodiments of an ammunition magazine and a pre-firing cartridge feed and storage antechamber, in accordance with aspects of the present invention.

FIG. 2 is a perspective illustration of another flexible-loading ammunition system, including an ammunition magazine 201 and a pre-firing cartridge feed and storage antechamber 203, in accordance with aspects of the present invention. Magazine 201 and antechamber 203 may have external dimensions similar to magazine 101 and antechamber 103, of FIG. 1, but some alternative internal mechanism embodiments are shown, and will be explained in greater detail, below. For clarity and consistency in reference, identical and/or similar structures in both FIG. 1 and FIG. 2 have been given the same latter two digits.

As with FIG. 1, force-loading 207 applies force to a follower 209 within magazine 201 to drive cartridges into antechamber 203, when antechamber 203 is properly engaged with magazine 201. In the instance of FIG. 2, however, a different one-way cartridge capturing and advancing mechanism within antechamber 203 is used to hold and drive cartridges into a firing chamber, an example of which is now shown in FIG. 2 as 239. More specifically, pairs of flexible or pivotable one-way guiding and one-way holding tabs, such as those shown as 241, attached to the outer surfaces of drivable belts 234 and 235 and shown on the faces of the belts facing inward, toward an ammunition storage cavity 230, guide cartridges driven into antechamber 203 by magazine 201 by flexing or pivoting upwards when cartridges are pressed upwards (and no cartridge is loaded in the position immediately above) against the lower surfaces of tabs 241 by follower 209. This loading configuration allows each cartridge to pass until it collides with a previously passed cartridge occupying space above it, or the bottom wall of the moveable bolt 242, if closed at that time. One way stopping walls, such as those shown as 243, prevent cartridges from escaping antechamber 203 downward, by holding tabs 241 against their bottom-facing surfaces, even if not held by the follower or cartridges driven by the follower, of magazine 201, which itself may or may not remain properly engaged with antechamber 203, depending on the operating phase of the firearm. To aid in seeing their operation and cartridge holding and advancing features, details of belts 234 and 235 are shown in greater detail in FIGS. 3 and 4.

A follower extender 245, shown in both compressed, 245*a*, and extended, 245*b*, configurations, is shown in zoom window 247. Depending on the amount of ammunition loaded in cavity 230, the follower extender 245 may extend upward past the housing 205 of magazine 201, and into antechamber 203 to drive cartridges more deeply into storage cavity 230. For example, if antechamber 203 were partially loaded with two rounds of ammunition, cartridges would occupy the top-most two positions defined by tabs 241 for holding cartridges. To prevent the creation of any gaps, for example, by insufficient cartridges being pushed from the magazine 203 to occupy all available positions in storage cavity 230, the follower extender 245 extends and drives as deeply as necessary until the last loaded cartridge from the magazine 201 abuts a loaded cartridge in antechamber 203, leaving no gaps between cartridges loaded in antechamber 203. To accomplish this follower extension, additional force-loading 249, dedicated to extending follower extender 245, and stretchable or unfoldable walls 251, enable a defined additional extension, which at least partly may occur when cartridges no longer fully compress follower extender 245, for example, by the release of variable cartridge holding tabs, as discussed in FIG. 1 and now shown as 215, and held cartridges, into a void within 230 in the engaged antechamber.

In the instance of the mechanism shown in FIG. 2, belts 234 and 235 are preferably not driven by force-loading from the magazine, 201. Instead, the automatic action of the firearm bolt drives belt-advancing gears 271 and 273, each of which drives one of belts 234 and 235 in opposing rotational directions (and only in those directions, for example, by a ratcheting mechanism engaged with the firearm action) and, in each full movement (fore and aft) of the cartridge-loading slide/bolt 283, belts 234 and 235 advance upward one cartridge position and load the top-most cartridge into the firing chamber.

In some aspects of the present invention, the loading opening of antechamber 203 may be at or more toward the top of the antechamber, rather than at the bottom, which may also aid in eliminating firing gaps in a cartridge conveyer system, such as that discussed with reference to FIGS. 2-4. FIG. 5, in part, depicts aspects of such an alternative embodiment.

Figure 3:
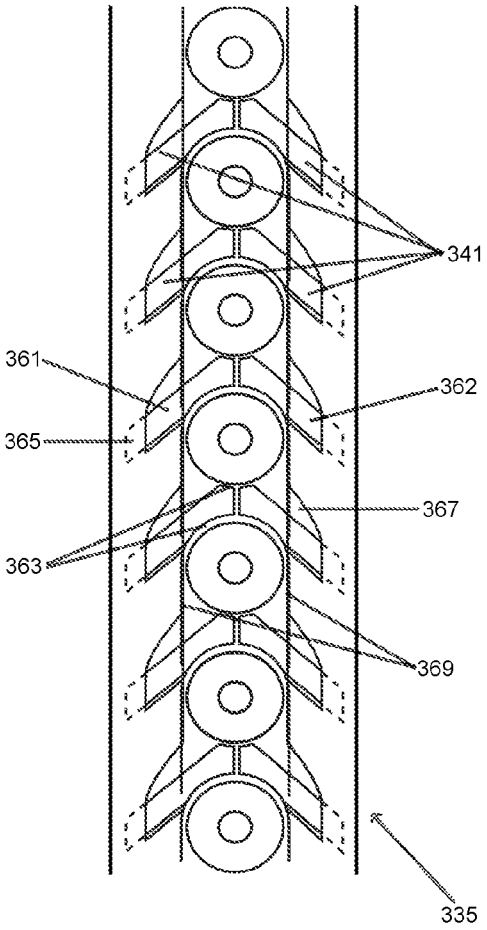
FIGS. 3 and 4 illustrate amplified feature details of cartridge advancing belts, which were previously shown in FIG. 2.
Figure 4:
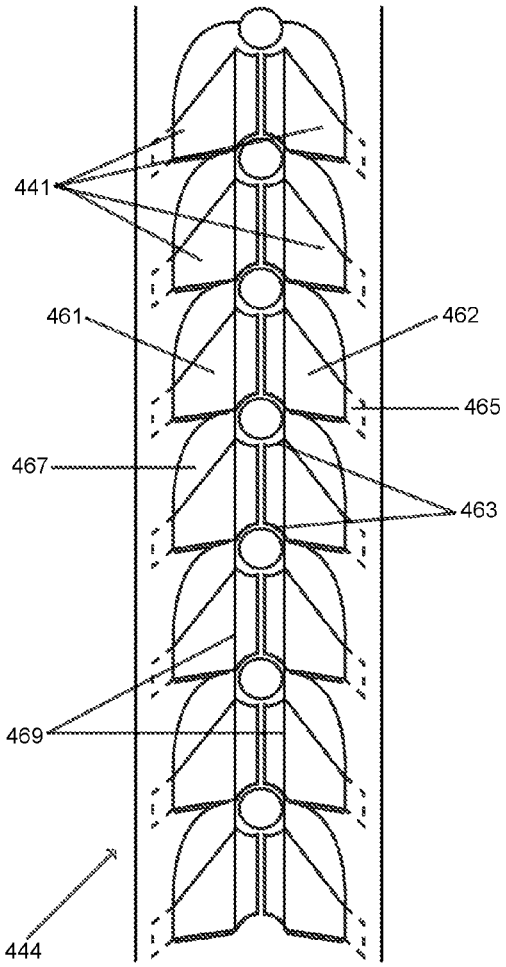
Figure 5:
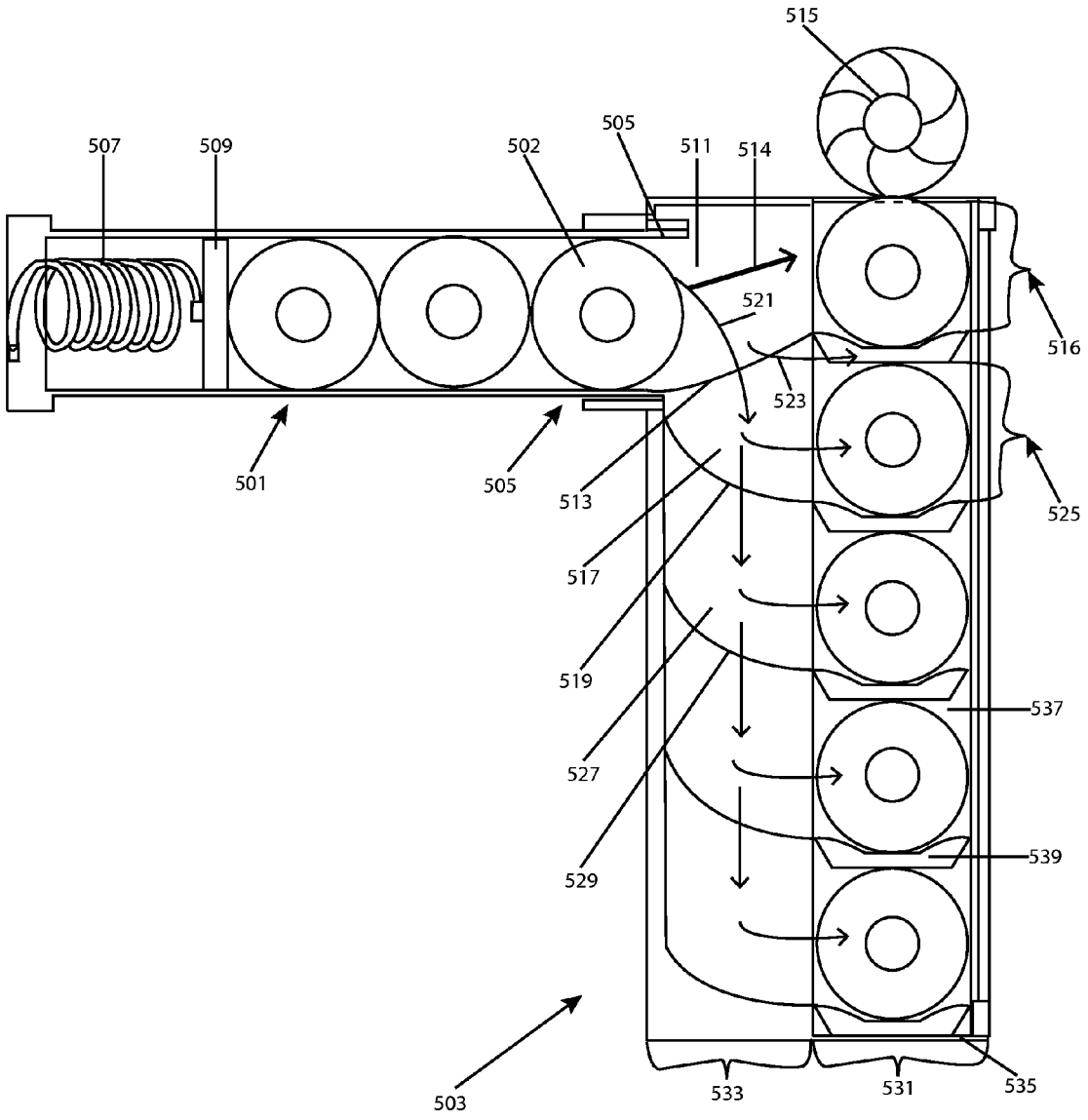
FIG. 5 is a side-view of an alternative embodiment for the antechamber of a flexible-loading ammunition system, in accordance with aspects of the present invention.

FIGS. 3 and 4 provide an illustration of amplified feature details of cartridge advancing belts 335 and 444, which were previously shown as belts 235 and 234 of FIG. 2, respectively. FIG. 3 provides a front view of the inward-facing side of the rear (butt-end) side advancing belt 335, while FIG. 4 provides a front view of the inward-facing side of the left-hand side advancing belt 444. Both drive belts, 335 and 444, contain flexible or rotatable cartridge holding tabs, shown as 341 and 441, respectively. Both sets of tabs are in pivotable or flexible converging mirror-image structure pairs of left- and right-hand side tabs, such as those shown as 361 and 362 and 461 and 462. The tabs, again such as examples 341 and 441, may be pivotably attached (e.g., by hinges) or flexibly attached (e.g., by bonding or barb) or otherwise attached to the remainder of belts 335 and 444 at attachment points/pockets, such as those shown as examples 365 and 465 of the belts 335 and 444. If a pivotable attachment is not used, preferably, tabs 341 and 441 and/or the remainder of the belts are made of a flexible material. In any event, ridges of tabs 341 and 441 grip edges of properly-loaded cartridges, as shown with reference to FIG. 2, and, because the pairs of mirror-image structured tabs converge more tightly against one another when pressed down, tabs 341 and 441 resist and/or prevent the passage of cartridges downward, holding them in place against gravity and other downward forces. If cartridges are pressed upwards, however, the set of mirror-image tabs above the cartridge will rotate and/or flex, permitting cartridges to move upward to the next higher position—if, and only if, that next higher position is empty. Sweep-permitting cavities 367 and 467 may assist in permitting the upward sweep and divergence of tabs 341 and 441 when so upwardly pressed.

Each belt may also include additional cartridge gripping ridges, such as those shown as examples 363 and 463 and side walls 369 and 469, each of which may be manufactured by cut away, injection-molding or otherwise by creating a relief from at least part of the flexible materials of at least part (such as the tabs) of the belts 335 and 444 themselves. These ridges 363 and 463 are in the outline of the ends of a cartridge to be gripped and advanced by belts 335 and 444, and aid in demonstrating the properly loaded position of such cartridges. More specifically, ridges 363 provide a gripping outline that may partially surround and hold the butt-end of loaded cartridges, while ridges 463 are shaped to complement the pointed, target-facing end of the bullet or cartridge, holding it in place.

Each of the tabs, such as examples 341/441, gripping tab ridges, such as examples 363/463, and gripping wall ridges, such as examples 369/469, vary between belt 335 and 444 to accommodate and hold the different shape of cartridges at the points held. It should be understood that such gripping and holding features may vary further as they extend outward (out-of-the-page of the figure) to accommodate and better complement and hold varying shape of a cartridge along its length. No particular size of such protruding features need be used but, preferably, the size of such features, in conjunction with the force dynamics of the belts and mechanism allow for easy movement of the belts around wrapping/turning elements at the tightness that they are used, while still allowing the advancing elements to drive the belts with sufficient, reliable grip. Also preferably, such protrusions and the material of which they are made permit them to flatten to some degree when wrapped around rotating belt-moving elements, to ease in wrapping about rollers or other turns in their movement, as may be necessary in particular embodiments of the invention. Of course, the precise shapes and sizes of the cartridge-complementary elements of the invention may differ substantially from those pictured in the figures, to complement and control the type(s), size(s) and shape(s) of ammunition components subject to the particular embodiment and the precise embodiment shown in FIGS. 2-4 are illustrative only.

FIG. 5 is a side-view of an alternative embodiment for the antechamber of a flexible-loading ammunition system. More specifically, a side-/top-loading magazine configuration, as opposed to the bottom-loading systems of FIGS. 1-4, is shown. Variably-attached side-/top-loading magazine(s), such as that pictured in an engaged position as 501, are conjoinable with a multiple-row channeled antechamber 503 at a side-top port 505, at or about the end of antechamber 503 closest to a firing chamber. Such side-/top-loading magazines may be variably locked with locking and release mechanisms such as those discussed with respect to FIGS. 1-4, for example, or any of several other known physical member locking/unlocking mechanism(s), though the mechanisms discussed specifically in this application are preferred. Upon properly engaging with antechamber 503, magazine 501 may be caused to release cartridges into antechamber 503, for example, by a variable insertion-released holding tab(s) or other mechanism that is released upon proper engagement, such as, for example, the cartridge magazine loading tab release mechanisms of the types discussed with respect to FIG. 1. As a result, force-loading 507 within magazine 501 causes a follower 509 to push cartridges into upper channel 511, defined by channel wall(s), ridge(s) or groove(s), such as that shown as 513, and in the direction of force arrow 514. If penultimate cartridge holding position 516 (prior to entering the firing chamber 515) is empty, this leads the first such loaded cartridge to be placed into that position. If, however, a cartridge is already present in position 516, the unreleased pressure against the next loaded cartridge leads that next cartridge to overcome the confines of channel wall, ridge and/or grooves such as 513, escaping downward into secondary channel 517, defined by channel wall(s), ridge(s) or groove(s) such as that shown as 519. The series of resulting forces exerted up to that point is thus approximately shown by force arrows 521 and 523. Force arrows 521 and 523 may also depict the motion of the cartridge unless the third-to-last position (second prior to the firing chamber) 525, is occupied, as the penultimate position to firing chamber was. If position 525 is so occupied, the cartridge may again be forced out of its new channel, 517, and again be forced downward into the next downward auxiliary channel, this time 527, defined by channel wall/groove 529, and so on with further channels below, until a position in the right-hand side row 531 of cartridges is open to receive the cartridge, or the cartridge reaches the bottom wall 535 of the antechamber 503. As with the mechanism depicted and discussed with respect to FIG. 2, a conveyor belt or belts 537 with cartridge holding features, such as the example provided as 539, preferably advanced one position upward per round of fire upon the action of the bolt/firing chamber clearing mechanism, also as in FIG. 2, is used to advance the cartridges held in row 531 to the firing chamber. In the embodiment of FIG. 5, however, holding tabs need not allow upward passage of rounds from below. Preferably, all of the channel walls, ridges and/or grooves are made of elastomeric, low-friction material and/or shaped to create primarily right-wards, and, secondarily (in terms of pushing strength), downwards pressure on cartridges within the channel, such that other force loading from the magazine is not required to continue feeding all cartridges into the firing chamber 515 upon sufficient firing. However, such force loading may additionally or alternatively be used to exert the channeling-related forces, and force arrows, discussed above.

Figure 6:
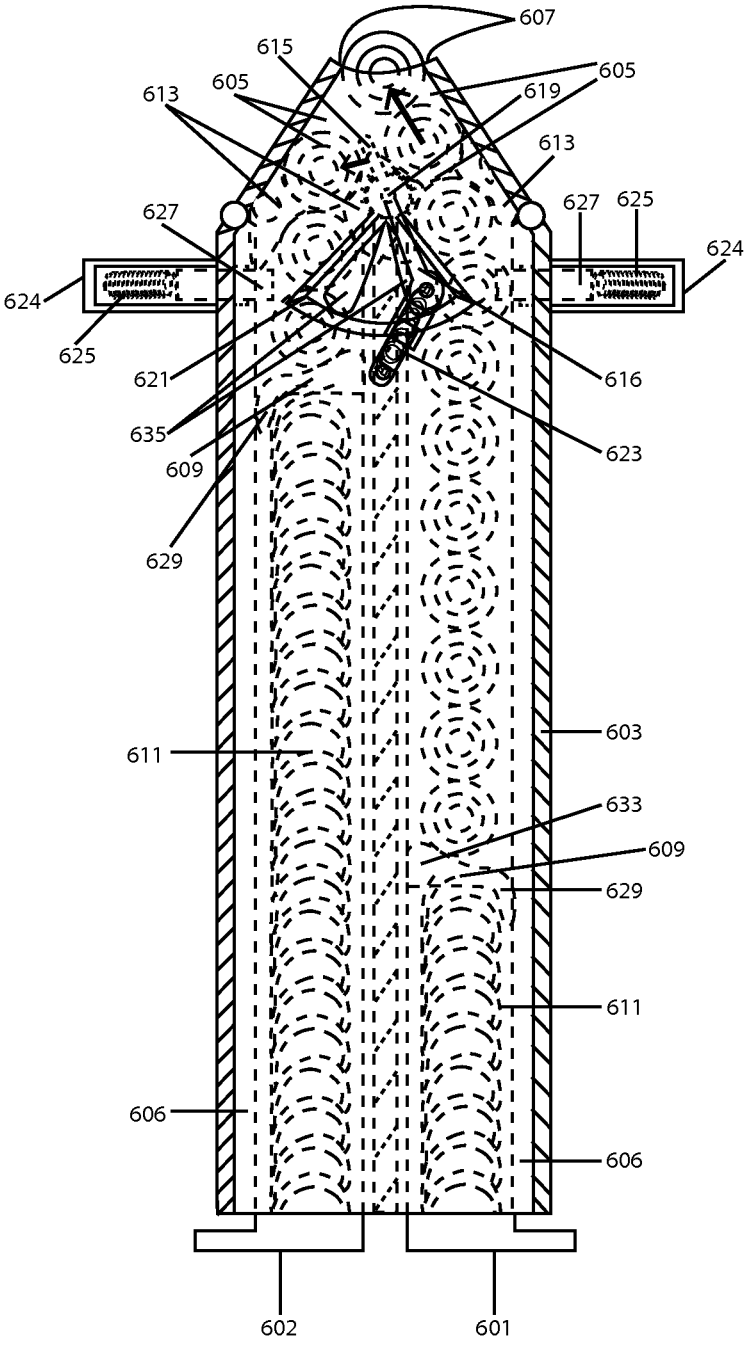
FIG. 6 is a side view of another flexible-loading ammunition system, including, but not limited to, a set of dual, separately changeable ammunition magazines and a pre-firing magazine receiving housing, comprising a cartridge feed and storage volume, in accordance with aspects of the present invention.

FIG. 6 is a side view of another flexible-loading ammunition system, including a set of dual, separately changeable ammunition magazines 601 and 602 and a pre-firing magazine receiving housing 603, comprising a cartridge feed and storage volume 605, in accordance with aspects of the present invention. Magazines 601 and 602 are shown fully inserted and locked in place (properly engaged) inside complementary cavities 606 within housing 603, which itself may be inserted into a magazine receiving section of a firearm, or may, alternatively, be an integral part of such a firearm, and provide cartridges to a firing mechanism via cartridge removal port 607. Cartridge removal port 607 variably holds cartridges within volume/feed 605 unless and until a firing mechanism or other cartridge removal action extracts them (e.g., engagement of the rear of the casing and sweeping of the cartridges into a firing chamber by an automatic slide and bolt of a firearm).

Prior to being slided into cavities 606, magazines 601 and 602 may be loaded with and retain cartridges via a variable holding mechanism which is released upon full mounting of the magazines (proper engagement) within cavities 606 and housing 603. For example, a variable retaining tab (or tabs) holding cartridges within the magazines may be cleared by a tab-clearing interfacing piece (not pictured) upon such full mounting—such as the cartridge-retaining tabs and tab clearing features discussed as 115-117 of FIG. 1. If so released, such a mechanism would then permit cartridges to be driven out of magazines 601 and 602 by followers 609 and their force-loading 611, and/or deliver upward pressure against any prior-loaded cartridges held in volume/feed 605. Prior to loading magazines such as 601 and 602, or after their unloading, cartridges already within volume/feed 605 may be retained, and still driven upward toward port 607 by compressible, flexible force-exerting bumpers 613. Bumpers 613 are preferably of an elastomeric or omni-directional force loaded materials and attached to inside walls of volume/feed 605 and housing 603, at locations that permit the upward passage of cartridges (with help from magazine followers 609, past the bumpers) but then oppose downward movement of such cartridges within volume/feed 605 and, through post-passage rebound, expand below such cartridges, driving them toward port 609. Bumpers 613 may alternatively be comprised of a more rigid surface material, but also comprise force-loading to achieve the same post-cartridge passage driving and retention, or accomplish those actions by any known method in the art.

A feed line selector 615, which leads cartridges from one magazine at a time to flow upward in reaction to cartridges being removed from port 607, is mounted near the center-bottom of and within volume/feed 605. Selector 615 is biased toward one of two rotational positions, defined by an attached lever 616 mounted on a common rotational axis 619 as it travels within a confining pocket 621 in an outside surface of the housing 603. Expansionary force-biasing 623 rotationally attached to both the end of lever 616 and, at the force-biasing's other end, at a point in the housing, tends to push lever 616 to one of two extreme positions against the outer walls of pocket 621, each corresponding with selecting one of two magazine feeds to flow upwards and holding rounds in the other. While both magazines are loaded and pressing cartridges upward toward volume/feed 605, selector 615 will tend to retain its latest selector position, allowing the flow of cartridges from one, but not the other, magazine, due to the action of force-biasing 623, which is sufficiently strong, with the action of the flowing cartridges to withhold cartridges. If, however, one of the magazines has been emptied after serving as the source for that flow, the selector will be driven into the opposite position, allowing cartridges to flow from the other magazine into the volume/feed 605, due to the absence of the additional pressure from the previously flowing cartridges. Further, either magazine, upon emptying, preferably will be immediately released by follower-actuated, force-biased magazine catch mechanisms 624, mounted in the housing 603. Force-biasing 625 within those mechanisms 624 cause interlocking members 627 to be forced within complementary holes within the housings of magazines 601 and 602. However, as the followers of the magazines rise with emptying, due to their own upward force-biasing 611, unlocking sub-features 629 depress and push out members 627, due to their outward-extending, sloped shapes, causing the magazine to be released downward by gravity from housing 603 upon release of the last round from the magazine into volume/feed 605. Windows 635 at the bottom of pocket 621 may also allow additional follower sub-features 633 to push lever 616 away from the pocket, to the opposing tack, and thereby encourage the proper selection of a cartridge feed from a remaining magazine that is still loaded with cartridges.

Figure 7:
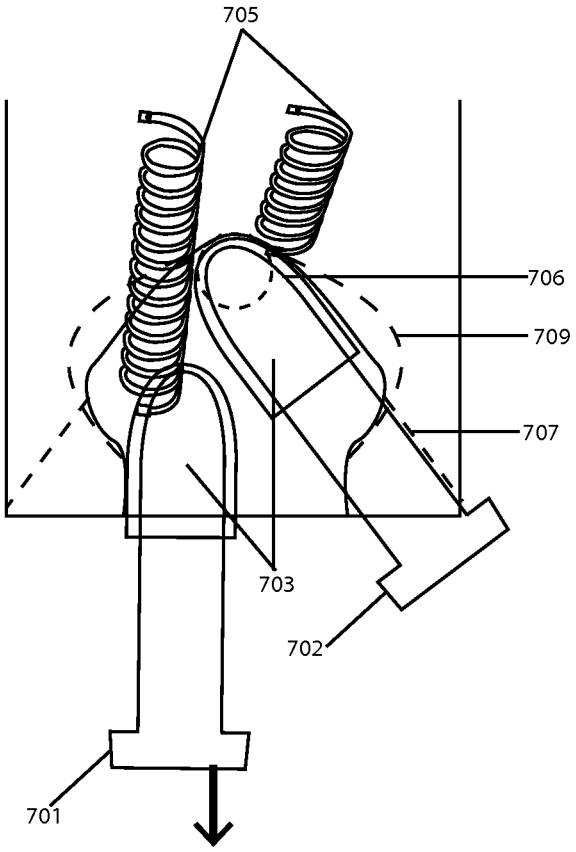
FIG. 7 is a side view of another flexible-loading ammunition system, including a set of dual, separately changeable ammunition magazines and variably-positioned magazine-receiving housings, in accordance with aspects of the present invention.

FIG. 7 is a side view of another flexible-loading ammunition system, including a set of dual, separately changeable ammunition magazines 701 and 702 and variably-positioned magazine-engaging housings 703, in accordance with aspects of the present invention. Upward force-biasing, such as springs 705, drive housings 703 upward, toward engagement with a firing chamber loading port 706 and/or a mechanism for drawing cartridges from a magazine mounted in the housings, creating a direct feed of ammunition to the firing chamber. However, only one such housing 703, which itself must be occupied by a loaded magazine, may occupy the engagement position at a time, which engagement position is illustrated by the right-hand-side magazine 702 and right-hand-side housing 703 with which 702 is shown engaged. If no longer loaded with a magazine, for example, due to recent ejection or other detachment of that magazine, such a housing automatically clears the firing engagement position because the magazine no longer holds the housing in place against a wall feature 707 retaining that position (and, in some embodiments, the system may forcibly eject such a magazine upon emptying). As a result, housing 703 may then be pulled into a channel defined by wall 709 (because it is no longer held away from it by the engaged magazine), which channel then would lead the right-hand housing 703 to be pulled out of the engagement position and into a position open for receiving a new magazine. At that point, the other, left-hand, housing 703 may enter the firing engagement position, if it has been loaded with a magazine and pulled back into a starting position, shown by 701, which leads to channel(s) leading to a position of engagement with the chamber port 706. As in other embodiments discussed in this application, preferably, upon emptying, magazines 701 and 702 cause themselves to be released from a variable interlocking mechanism with their housings, 703 or may, as discussed above, be forcibly ejected by the system. In addition, any of the movements discussed above may be alternatively forcibly actuated with any known method or apparatae in the art, including, but not limited to or server motor actuation by a control system, such as a computer and/or processor in actuating connection with such servo motors (not pictured).

Figure 8:
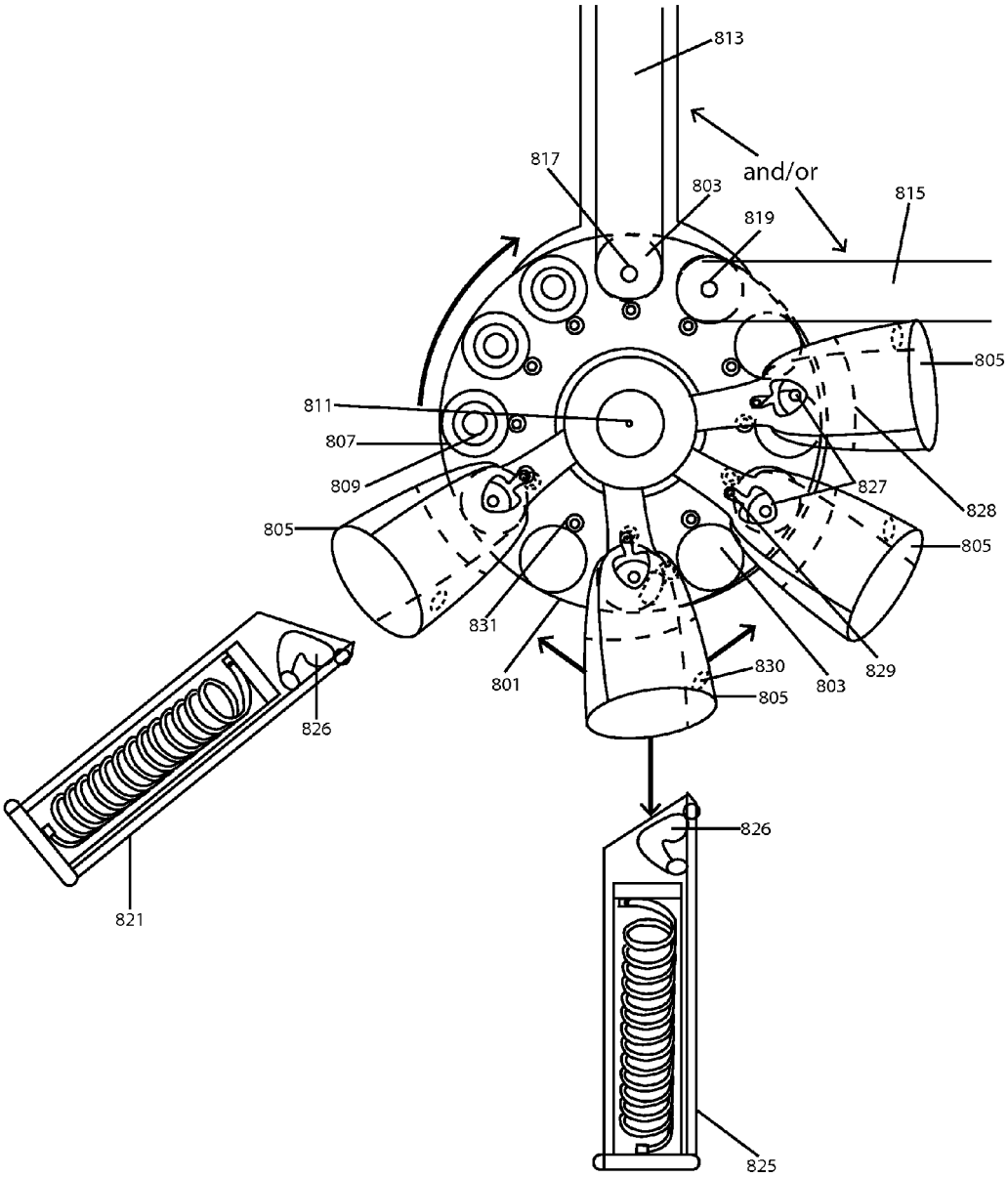
FIG. 8 is a depiction of aspects of another flexible-loading ammunition system, including a rotatable cylindrical set of transposable firing chambers, that may be variably loaded by magazine feeding leaves.

FIG. 8 is a depiction of aspects of another flexible-loading ammunition system, including a rotatable cylindrical set 801 of transposable firing chambers, such as those examples shown as 803, that may be variably loaded by magazine-feeding swinging holders 805. Certain of the firing chambers, such as chamber 807, are shown filled with an ammunition cartridge, such as 809, and the figure provides a rear (butt-end) view of such the chambers and loaded cartridges. The cylindrical set of chambers 801 may rotate about an axis 811, and a firing mechanism and/or action (or multiple mechanisms and/or actions) such as those partially depicted as 813 and/or 815, may cause the clockwise rotation (facing the figure) of set 801, such that a new, loaded chamber, if available, is engaged with the either or both firing mechanisms and a rifled barrel prior to firing. Firing pin(s), such as those shown as 817 and/or 819, may be caused to strike the rear, primed section of cartridges upon such firing.

Swinging holders 805 may swing on rotating joints about the same axis, 811, on which cylindrical set 801 rotates. Holders 805 may variably engage with exchangeable magazines, such as those examples pictured as 821 and 825, for example, by any of the interlocking and engagement mechanisms for magazines discussed elsewhere in this application, or by engagement-driven hooks or tabs, such as those shown as 826 that may pop-out of the magazines and interface with ports in holders 805, such as that shown as 830. Holders 805 may comprise sliding cartridge advancers, such as those examples pictured as 827. Such cartridge advancers may slide in the direction into the page (of the figure) with a physical edge that, in so sliding, catches a top-most cartridge in a conventional ammunition magazine, removing it from the magazine and inserting it into an empty firing chamber, such as those pictured as 803, through a holder window, such as 828, in the set 801-facing side of the holder (into the page), if and when set 801 moves such an empty chamber past such a window 828 of a holder 805. Cartridge advancers 827 may each include attached advancement permitting/reversing pins 829 that allow such cartridge insertions by entering pin holes 831, but which holes force the pins 829 and advancers 827 back (toward a viewer of the figure) after so inserting a cartridge (for example, by a force-loaded rod that forces any pin 829 back out after loading). Such force-loaded rods may be reset, deeper into the holes 831, to accept pins 829 again by gearing or channeling driven by further rotation of the set 801, but only when the immediately neighboring chamber is empty. In any event, the rod action pushing pins 829 out of holes 831 resets the force-loaded cartridge loading action of advancers 827 behind the next cartridge, emerging at the top of the magazine in place of the last removed top-most cartridge. Because the casings of the cartridges include a rear lip wider than the remainder of the cartridge, and wider than chambers 803, such cartridges loaded in chambers 803 are then ready for striking by firing mechanisms 813 and/or 815 by opposing a strike by firing pins 817 and/or 819. Also because of those structural lips and/or the presence of an emerged, pin-removing rod within a hole 831, advancers 827 will not move additional rounds into a chamber that has already been loaded, and, instead, holders 805 with conjoined magazines will pass over such loaded chambers, and proceed to load adjacent empty chambers, if any, that next pass under them.

Magazines, such as those pictured as 821 and 825, may variably and releasably conjoin with holders 805 according to aspects discussed elsewhere in this application, for variably conjoining and releasing magazines to other structural parts (for example, as discussed in reference to FIG. 6), or by any other methods for conjoining and releasing magazines known in the art. Again, it should be noted that the particular mechanisms depicted are illustrative only, and are not exhaustive of the techniques within the scope of the invention. For example, a mechanism whereby cartridges automatically are advanced from magazines after proper engagement, such as the techniques discussed in reference to FIG. 1, may be used, rather than the advancer system discussed in reference to this figure.

Figure 9:
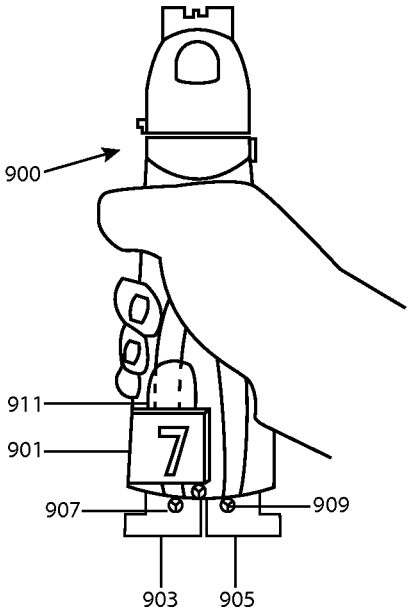
FIG. 9 depicts a magazine-communicating firearm system which may be used, for example, as a part of multiple-magazine, flexible-loading firearm and firearm antechamber systems, such as those described in reference to FIGS. 7, 8 and 10, according to aspects of the present invention.

FIG. 9 depicts a magazine-communicating firearm system 900 which may be used as a part of multiple magazine, flexibly-loading firearm and firearm antechamber systems, according to aspects of the present invention. If used in a handgun, a shot-counting display 901 preferably is placed on lower left-hand (and/or, if the user is or may be left-handed, on the lower right-hand) and at least partially rearward and/or user's eye-ward facing sides of the handle. However, in any firearm, such a display is preferably placed on an eye-ward facing surface, or within a an otherwise rapidly-acquired user interface (such as, but not limited to, user interfaces that may be within a site and/or a goggle or eye-shield heads-up display). Each or any loaded magazine, such as those shown as 903 and 905, loaded into firearm system 900, contain communication-enabling elements, such as those examples shown as 907 and 909, which may communicate both with internal sensors and/or a processing system 911, which contains a computer, memory, software, logic/state machine and/or processors, and also is in communication with and able to control the output of display 901. Elements 907 and/or 909 may, for example, comprise physical contacts that, when connected upon engagement of one or more magazines such as 903 and 905, lead to initiation of communication. Alternatively, elements 907 and/or 909 may comprise antennae or other radio frequency and ambient power delivery and recognition aspects, for initiation of communication. System 911 may also be in communication with motion sensors and/or antechamber sensors, which aid in counting or inventory of shots fired and/or cartridges loaded or depleted within a magazine(s), an antechamber(s) and/or firing chamber(s), such as those magazines, antechambers and firing chambers discussed elsewhere in this application. In addition, system 911 may, with or without the aid of a battery and electromagnetic or electric power transferring elements, power sensors and communication units 903 and 905, in addition to communicating with them. System 911 and any associated batteries and/or capacitors may also be charged by motion driven or ambient power capturing sources, such that the loading, recoil or other firearm actions and movements of the firearm may recharge the system, obviating the need for battery changes or other external powering which may, alternatively, be used in accordance with aspects of the invention. In any event, through such system 911, and any such sensors or inventory count-down techniques, a current accurate count of available ammunition in the firearm for firing may be relayed to a user of the firearm (as pictured) as well as the identity of the currently used magazine and/or the available ammunition per magazine (not pictured).

System 911 may include software that may maintain an accurate count of available rounds for firing, magazine status, and other firearm data (e.g., drag from machine debris related to potential jamming, overheating or current barrel temperature, from such sensors) and may be resettable, calibratable or otherwise count- or other output-manipulable by a user and/or ordinary actions of system 900. For example, upon ejection of one or both magazines, the system may remove any count of cartridges from that magazine from its total count of available rounds, and may, in lieu of internal magazine sensors, add a standard number of rounds upon detecting the loading of the next magazine loaded to the total count. As another example, a user interface may be used to adjust any settings and enter any such necessary user/system selections and data.

Figure 10:
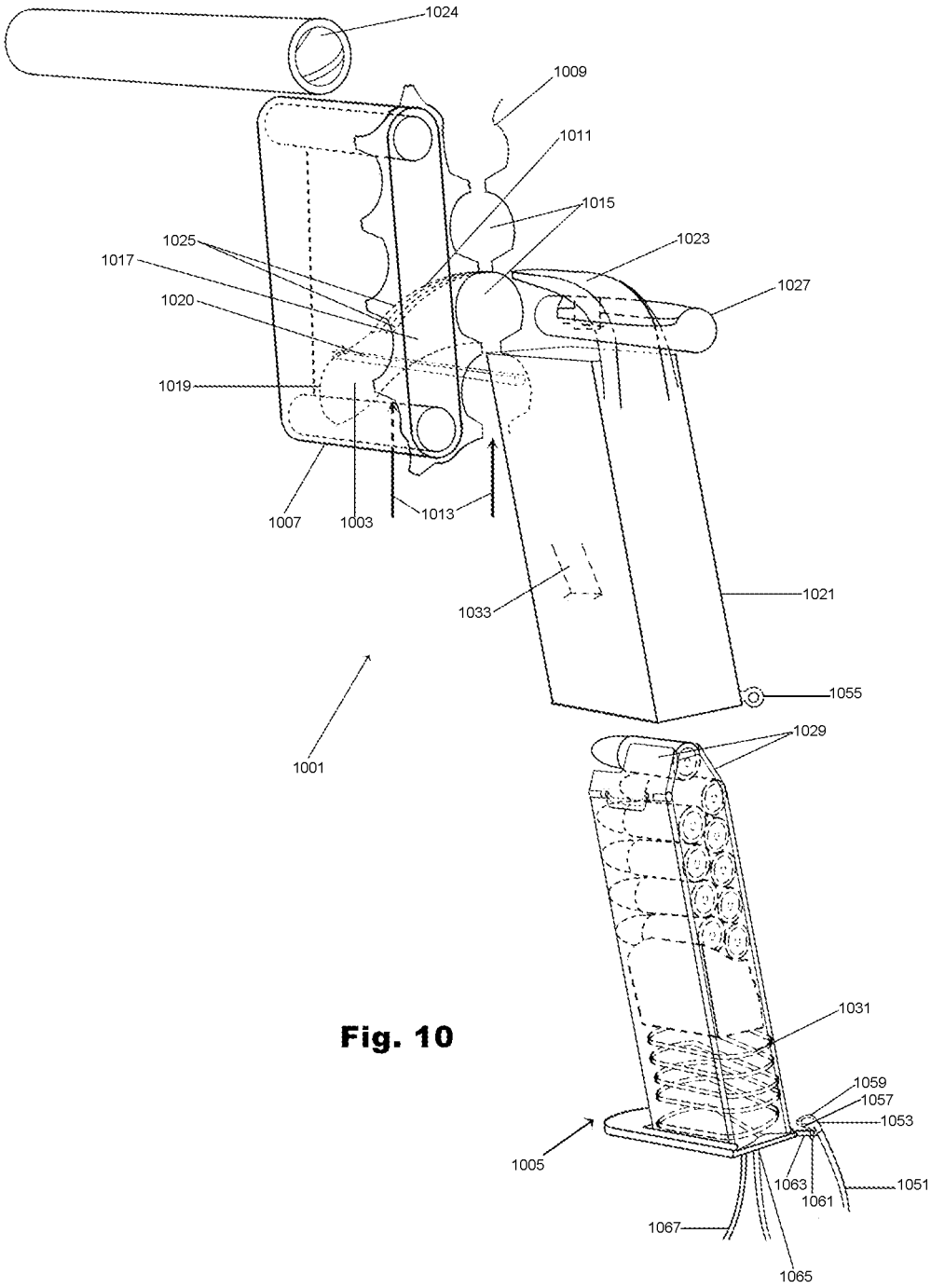
FIG. 10 depicts aspects of another flexible-loading ammunition system, including belt-driven and -defined pre-firing cartridge advancement intermediate chambers and the use of exchangeable magazines.

FIG. 10 depicts aspects of another flexible-loading ammunition system 1001, including belt-movable and -defined pre-firing cartridge advancement intermediate chambers, such as that shown as chamber 1003, and also including the use of exchangeable magazines, such as that shown as 1005. A set of two belts, including a left-hand-side belt 1007, pictured, and a right-hand-side belt 1009, partially pictured, comprise movable chamber-defining wall contours, such as those partially depicted by contour 1011. (To aid the viewer by avoiding confusion from many intersecting lines in the figure, the contours for only one exemplary chamber, 1003, are fully shown in FIG. 10.) More specifically, the inner-facing surfaces of left conveyor belt 1007 and right conveyor belt 1009 converge, but need not completely touch one another, along a separation plane depicted by arrows 1013. However, it should be understood that a movable, variable series of such chambers in parallel configurations, above and below, are present along that plane where the inner-facing surfaces of belts 1007 and 1009 lay next to one another. Each such chamber may comprise, in part, a cartridge entry port, such as those shown as 1015, a downward curving tunnel, such as that shown as 1017, and an exit port, such as that partially shown as 1019. As will be explained in greater detail below, cartridges may be fed into such entry ports and, depending on the embodiment of the invention, may, in so doing drive both belts 1007 and 1009 upward (on the side of each belt facing one another) delivering such driving force from a support rod 1020, attached, for example, to intermediate magazine-accepting and cartridge-advancing and feeding housing, 1021. A cartridge reaching the top of the convergences of the inner-facing surfaces of belts 1007 and 1009 may be driven upward to that position by lower cartridges entering lower ports and their respective tunnels from magazine 1005 and intermediate housing 1021, and thereby delivering force to the upper (ceiling) contours of the belt-defined tunnels (such as 1003). However, a cartridge-inserting and -clearing semiautomatic or automatic action bolt, chambered cartridge and/or other such member may be present, and therefore resist further upward movement of a top-most cartridge held by belts 1007 and 1009 (or may resist contours of the walls themselves, or gearing features of or related to the belts' movement). In any event, further movement of the belts is arrested until such time as a firing and clearing action, removing such members, takes place. Alternatively, or in addition, a firing and/or recoil actuated cartridge driver (discussed below) may also or alternatively halt or advance the next lower cartridge in the magazine from housing 1021 through outward guide 1023 until the next, empty belt-defined chamber has been raised to the level of the position of a cartridge exiting housing 1021, along the bottom of guide 1023, rather than rely on force biasing of cartridges pushed into empty chambers, such as 1003.

By holding cartridges and advancing them only upon firing action, in a sense, belts 1007 and 1009 may serve as an intermediate set of storage chambers, ancillary to storage by the magazine. Preferably, auxiliary force-loading of the belts' movement, or action-driven gearing of them, will lead to the advancement of cartridges within the belt-defined chambers, such as 1017, and enable further firing even if a magazine, such as 1005, is no longer loaded into intermediate housing 1021 and providing force-bias drive to the belts. In an alternative embodiment, aspects of which are also, alternatively, pictured, the chambering of rounds by a bolt or other action (not pictured) may occur at a position lower than that of the top of the belts and barrel/firing chamber, 1024, such that, upon sweeping a cartridge into barrel or pre-barrel chamber, such as 1024, the resulting force against cartridge top-pressing ceiling features (such as those pictured as 1025) itself results in driving the belts upward, and preparing the next lower cartridge for loading.

Any number of interchangeable ammunition storage magazines, such as that pictured as 1005, may be used in some embodiments and aspects of the system 1001, including, but not limited to, conventional magazines. When loaded into intermediate housing 1021, cartridges may exit the magazine 1005 and housing 1021 toward the belts' (1007 and 1009) inward convergence and, preferably, a firing and/or recoil actuated cartridge driver 1027 drives each cartridge separately into an empty belt-defined chamber and may, as mentioned above, halt the further advance of cartridges held below, in the magazine, unless and until a new, empty belt-defined chamber is presented at the level of the driver 1027. If conventional magazines are used, driver 1027 must be of a type shaped to catch the back of casings of cartridges exposed through casing-griping ears, such as those shown as 1029, such that the driver may unload such a conventional magazine. But, preferably, a specialized magazine with force-biased but spreadable ears (e.g., to be opened upon engagement with the housing), pictured as 1029, is used. In that embodiment, the cartridges need not be unloaded from the magazine, such as 1005, by a driver 1027 and the force from a magazine's force-loading, such as spring 1031, along with leaf-spreading tabs 1033, within the housing 1021, lead to loading cartridges into ports, such as those pictured as 1015. However, for such an embodiment to work, cartridges must be substantially larger than that pictured in FIG. 10, such that they fully occupy the belt-defined chambers, such as 1003, and resist the further loading of cartridges until they have been advanced upward from the loading position, due in part to a wall (not pictured) blocking the exit ports, such as that pictured as 1019, unless and until the back-pressure from other cartridges is cleared and/or firing chamber is reached. If force-biasing is not used to drive belts, and the upward pressure of cartridges being swept out of the belts, is not used to used to drive belts, the chambers, such as that shown as 1003, need not be curved.

In the event of firing without a loaded magazine—which may be useful in the field, for example, in the event of interrupted loading by combat circumstances—at least temporarily empty belt-defined chambers may result, which may be thought of as firing gaps. To aid in filling such gaps, multiple outward-flowing channels, similar to those discussed in reference to FIG. 5, may be used, especially in relation to the embodiment discussed immediately above, if a higher position for the top most housing exit guide 1023, is used, with parallel, lower housing guides with partly open roofs, that allow upward passage of cartridges, unless and until back pressure from a loaded cartridge resists loading at that position.

Because several embodiments described in the present application may implement system-directed ejection of ammunition storage magazines, after empty, without the further aspects discussed below, they may create an issue of lost or mishandled empty magazines, depending on the alertness, experience and goals of the user. Most conventional firearms do not cause ejection of magazines after empty, and some embodiments of the present invention do not either. However, preferably, at least a partial ejection of emptied magazines occurs, to alert a user with a tangible physical change that a magazine has been emptied, much as a last shot "locked open" bolt may signal emptying of an entire firearm, in some automatic firearms. For example, when emptied, a magazine may disengage and shift its position, but not fully drop from the weapon, with the aid of stays, partially-ejected position tabs or attached cords that catch the disengaged magazine, or channel/wall features that temporarily hold the magazine in a disengaged, partially ejected position. In one embodiment, partially pictured in FIG. 10, such a cord or stay 1051 is shown attached both to the magazine 1005 base and an eyelet-capturing spreadable snap 1053. Snap 1053 and interfacing eyelet 1055 are each located on the lower-right-hand-side of a housing—the housing of magazine 1005 and the cartridge-advancing and feeding housing 1021, respectively. As a magazine such as 1005 is slid into its proper engagement position, within housing 1021, surrounding snap members 1057 and 1059, which preferably have rounded interfacing surfaces, snap into place and conjoin with eyelet 1055 by spreading over eyelet 1055's outer ring structure and entering the void at its center. Snap 1053 is preferably at least semi-permanently attached to cord or stay 1051, but temporarily held into its place at the lower-right-hand-side of the housing of magazine 1005, such that, if magazine 1005 is ejected from housing 1021, snap 1053 remains attached to eyelet 1055 and, therefore, housing 1021. But, because snap 1053 is only temporarily directly held to the housing of magazine 1005 (for example, by accepting a pin 1061, which is attached to snap 1053, downwardly-inserted into a pin acceptor 1063) snap 1053 will not follow magazine 1005 down as it is ejected. Because cord 1051 is attached to both by attachment point 1065 with magazine housing 1005 and eyelet 1055 of housing 1021, the magazine 1005, resultantly, remains indirectly attached to housing 1021 after ejection via stay/cord 1051. Preferably, snap 1053 is held in place conjoined to eyelet 1055 with sufficient strength to retain its connection even after absorbing the full force of the falling magazine, but is impermanent enough to allow a user to pull the snap loose. Also preferably, stay/cord 1061 is sufficiently long to permit the ejected magazine 1005 to fully clear housing 1021, and leave it open for insertion of a new magazine, but, in some embodiments, full ejection, and such long cords or stays, may not be preferred. As with all other described embodiments in this application, the particular stay implemented is by no means exhaustive of the many alternative possibilities within the scope of the present invention, and other stay mechanisms, such as flexible interior housing tabs, snaps, channels or other stays may, alternatively, be used. Finally, a cord 1067 may connect magazine 1005 with another attachment point, or even a winch or other play-gathering device that detects when a magazine has been ejected, reels it in and sequesters it. Such a device may include a processor, memory, software, sensors and/or actuators and may comprise padding where the magazine comes to a rest after being reeled in (e.g., on a soldier's belt or other equipment) to absorb the shock of the magazine and hold it in place after it is ejected. As one alternative, cord 1067 may be at least partially around a user's neck and/or shoulder to avoid losing the magazine, preferably by a variable loop which may be defined by a floating, cinching and gripping ring, and may let more than one cord attach to a magazine, or any other retained equipment, at multiple locations on the equipment.

Figure 11:
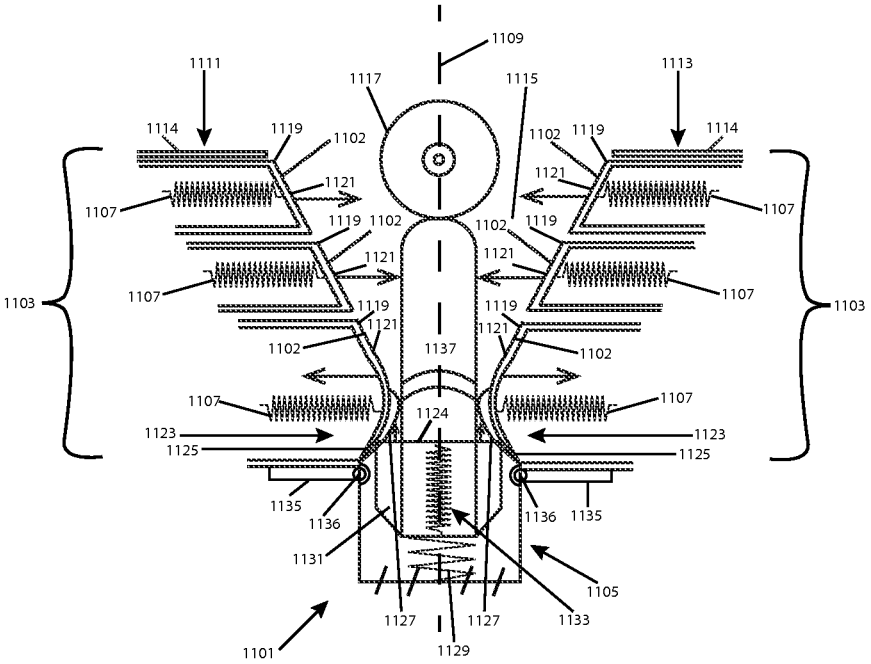
FIG. 11 is a rear view depicting aspects of an exemplary flexible-loading ammunition system, comprising cartridge-retaining and -advancing wall pieces in an intermediate cartridge storage and advancement device.

FIG. 11 is a rear view depicting aspects of an exemplary flexible-loading ammunition system 1101, comprising cartridge-retaining and -advancing wall pieces 1102 in an intermediate cartridge storage and advancement device 1103. As with other intermediate cartridge storage devices for flexible-loading ammunition systems set forth in the present application, in different embodiments, device 1103 is integral with or mounted on a firearm and is able to be loaded, supplemented and load-completed by coupling with any of several ammunition magazines, such as exemplary magazine 1105. Also as with other intermediate cartridge storage devices set forth in this application, device 1103 is able to retain and advance several cartridges held within it whether or not a magazine is presently engaged with it, and the firearm remains firing-ready even if a magazine had been emptied, and/or a soldier is in the process of loading the firearm and/or replacing an empty magazine.

Wall pieces 1102 comprise force-loading (such as exemplary springs 1107, attached to an external wall of the intermediate storage device 1103, or of a firearm (not pictured)) that bias and push wall pieces 1002 inward toward a central line or plane 1109, which bisects system 1101 and a firearm in which it is comprised or installed. Wall pieces 1102 are present in two groups or banks—a left-side bank 1111, and a right-side bank 1113, each of which are encompassed and held vertically in place by retaining walls 1114 attached to a housing of the intermediate storage device or the firearm (not pictured). Force-loading 1107 drives pieces 1102 within left-side bank 1111 toward the right-hand side of the figure, and drives pieces 1102 within the right-hand side bank 1113 toward the left-hand side of the figure, tending to close a central void 1115. If interfering hard objects are not present within lower regions of central void 1115, at least some of pieces 1102 from left side bank 1111 may collide with pieces 1102 from the right side bank 1113, or, otherwise, they may move together to close central void 1115 to a degree necessary to prevent the escape of any cartridges held within intermediate storage device 1103 (such as exemplary cartridge 1117), which might otherwise escape, for instance, due to gravity (downward, in the perspective of the figure). For example, if the cartridge size which system 1101 is servicing, such as the size of cartridge 1117, has an outer case diameter, at its base, of 0.377 inches, preferably, the pieces 1102 from side 1111 will converge toward the pieces 1102 from side 1113, and vice versa, with less than 0.377 inches of horizontal space between them at any point, including their upper inward-facing edges 1119. Even more preferably, there will be less horizontal space between fully converged pieces 1102 than the diameter of the cartridge at any point along the majority of its length or casing. As can be seen in the figure, the inward-facing surfaces 1121 of pieces 1102 are each generally sloped upward at an angle that, with inward pressure from force biasing 1107, forces an object (such as a cartridge) upward, if it is placed between pieces 1102 from side 1111 and 1113, unless and until the object collides with another object above it—such as cartridge 1117, another cartridge, or a part of a firearm action above it (not pictured). But, if it meets no such upward limit, a cartridge held between pieces 1102 will rise upward, and be presented for placement into a firearm action above—for example, due to the cycling of a bolt, opening a void in the action for receiving such a cartridge. As a result, intermediate cartridge storage and advancement device 1103 serves to convey cartridges held within it, upward, delivering them, as needed, to a firearm action.

The lowest pair of wall pieces 1102, shown as 1123, comprise additional design features, to accommodate coupling with, and receiving cartridges from, a magazine, such as exemplary magazine 1105. Lowest pieces 1123 also comprise an outward slope to their inward-facing surfaces, as they progress downward, facilitating the entry of the top 1124 of magazine 1105 between them, which simultaneously serves to spread them apart, allowing the introduction of cartridges between them. Thus, the lowest edges 1125 of the inward-facing surfaces 1121 of pieces 1123 are substantially farther apart than at a more vertically central point, above those edges. In addition, those inward-facing surfaces are preferably smooth, and their slope is continuous, to facilitate easy insertion and movement of the magazine 1105, and any cartridges resultantly introduced into intermediate cartridge storage and advancement device 1103, upward. As magazine 1105 is inserted into intermediate cartridge storage and advancement device 1103, and between lowest pieces 1123, cartridge retaining tabs 1127 are also preferably spread apart causing the release and movement upward, into cavity 1115, of cartridges held in magazine 1105. Force biasing within magazine 1105, such as main spring 1129 attached to follower 1131, and extender spring 1133, serves to push and introduce cartridges from magazine 1105, into void 1115, once tabs 1127 have been spread. The spreading of tabs 1127 may be facilitated by attached levers 1135, pivoting on hinges 1136, which collide with a lower wall of intermediate storage device 1103, lower pieces 1123, or another object comprised in the firearm (not pictured). An extending, penetrating and upwardly force-biased member(s) 1137 may, in some embodiments, aid the clearing and raising upward of cartridges within cavity 1115, urging them toward introduction within the firearm action, promoting clearing and preventing jamming. Preferably, member(s) 1137 extend(s) from magazine 1105, but, in some embodiments, it/they may be present within the remainder of the firearm, or otherwise variably introduced. If present within the firearm, member(s) 1137 may also be introduced into void 1115 part of the time, and remain clear during loading, load completion and/or load supplementation from magazine 1105, as discussed above. If member(s) extend from magazine 1105, they are preferably held within magazine 1105 by tabs 1127 (or cartridges held by them), unless and until magazine 1105 is introduced into and coupled with intermediate storage device 1103.

An additional lock, tab or other holding device (not pictured), which may be released by a user, may aid in maintaining a coupled state between magazine 1105 and intermediate storage device 1103. Such devices are omitted for simplicity in the present figure, but have been covered in detail above, in other embodiments involving the coupling and user- or system-actuated (e.g., upon emptying of the coupled magazine) release of magazines from intermediate cartridge storage devices.

Figure 12:
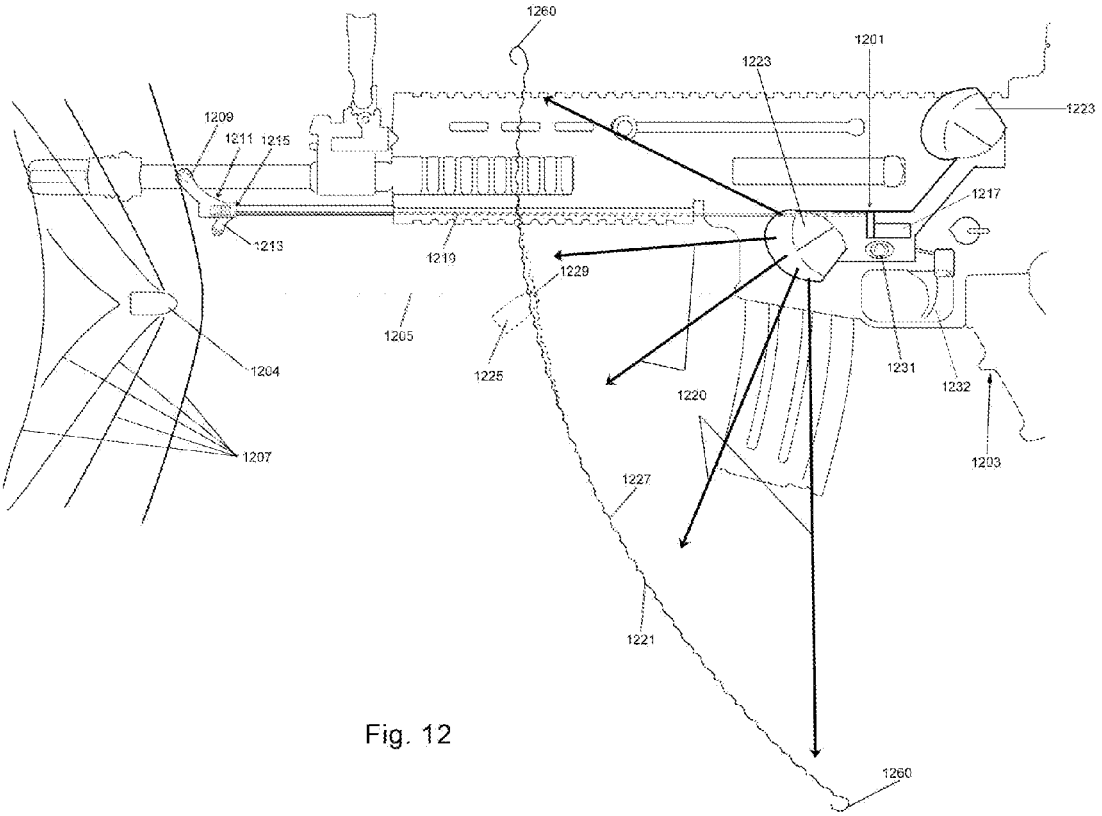
FIG. 12 is a side view depicting aspects of an exemplary projectile-blocking ballistic protection device mounted on a firearm.

FIG. 12 is a side view depicting aspects of an exemplary projectile-blocking ballistic protection device 1201, mounted on an exemplary firearm 1203. Preferably, device 1201 is mounted on firearm 1203, at a location selected not to interfere, or to minimally interfere, with the ordinary operation of the firearm. But the mounting location and configuration is also preferably selected to present user controls in easily, intuitively accessible locations, to control the functions of device 1201, and conduct systems and methods in accordance with aspects of the present invention, which will be set forth in greater detail below.

Also pictured in the figure is a ballistic bullet 1204, traveling from the left-hand side of the figure, and toward the right-hand side, along an initial projectile path 1205. A pattern of sound waves, and/or other air disturbance, depicted as compression wave pattern 1207, emanates from, and is shown around, bullet 1204 at an instant as it travels through the air along path 1205. The instant at which bullet 1204 and waves 1207 are pictured is the point in time when waves 1207 reach a first receiving horn 1209, of a specialized, location-aiding microphone headpiece 1211. After some of waves 1207 reach and pass through horn 1209, other parts of waves 1207 will then reach a second horn 1213, located farther away from the firing source of the bullet (not pictured within the view, but on the left-hand side of the figure) than horn 1209. As will be explained in greater detail below, in reference to FIG. 13, horns 1209 and 1211 each comprise a hollow housing, compression wave entry holes and a differential medium, to aid device 1201 in distinguishing between sound or other waves entering horn 1209 and 1211, and deriving therefrom a probable speed, location and interception path, for intercepting bullet 1204 by launching interception media. Headpiece 1211 is mounted on a main microphone or sensor unit 1215, which is wired or otherwise capable of communicating with a computer unit 1217 comprised in device 1201. Communication wires 1219 present one such possible wiring configuration, which may be preferred in some embodiments to aid in transmitting high speed, clean information between microphone/sensor unit 1215 and computer unit 1217, without the need for separate power sources, computer hardware and antennas within units 1215 and 1217, and without interference and other wireless signal transmission issues. However, it should be understood that a wide variety of other, alternative communications configurations and embodiments may be implemented instead of or in addition to that pictured, and some of such configurations and embodiments have some advantages. For example, a wireless transmission method may be accomplished without a separate, additional local computer comprised within microphone/sensor unit 1215 if the unit 1215 is directly connected to a transmitter that beams a raw, analogue transmission signal generated from the microphone magnet directly to computer unit 1217. In addition, a wireless transmission method may be preferred for maximizing the speed of the transmitted signal, because electromagnetic radiation through air is considerably faster (by a factor of nearly 100×) than the speed of electronic signals over wires. Either approach, or variations and combinations of them, or other approaches, may be used, however, while still carrying out aspects of the present invention. Wireless and wired signal transmission speeds, in conjunction with the speed of the computer hardware implementing other aspects of the invention required for intercepting a projectile, and the speed of launching interception media 1221 (as will be discussed below), exceeds the speed of a projectile triggering the interception media 1221 through unit 1215.

The signals transmitted from unit 1215 are received as input in computer unit 1217, which is specialized and configured to separate wave patterns and create different resulting signals related to sounds or other compression waves captured by horn 1209 and horn 1213, due to the differing filtering media in each horn (as will be discussed in greater detail below). By receiving those signals, and interpreting how they differ from one another, when they each are initiated and how they change over time, and identifying sound models corresponding with bullet speeds and locations, the computer unit 1217 is able to rapidly determine a location, flight path and interception path for bullet 1204, for example, using configurations and programming set forth below with reference to FIG. 14. Horn 1209 is located not only further toward the muzzle of firearm 1203 than horn 1213, but also at a higher location vertically, with differing internal reflections and muffling effects that change depending on the location and flight path of a ballistic source of sound. Libraries of different ballistic trajectories related with different sound characteristics for the particular headpiece 1211 and overall unit 1215 (and firearm on which it is mounted, and other environmental conditions assessed to be present) are rapidly matched by the computer system 1217. In some embodiments, derived relationships (which may be mathematically expressed) between perceived sound characteristics and projectile trajectories may also, or instead, be applied to the sound signals received in computer unit 1217 to determine a probable flight path for a projectile source of the sound. If the matched sound and/or characteristics and a flight path or trajectory (or probably flight path or range of possible or probable flight path/trajectories) matched thereto for particular microphone or other wave phenomena input received in computer unit 1217 indicates a bullet flight path or trajectory with a high probability of collision with the firearm user, the computer unit 1217 then transmits a triggering signal to an electronic detonator for a propellant, an electrically-actuated compressed gas release valve (or another propellant initiator) in at least one of interception media launching units 1223. Preferably, the transmitted triggering/detonating signal is timed to account for all factors impacting the projectile's present position, trajectory over time and, in particular, to cause a maximally effective interception of the projectile with a planned interception path of interception media launched from media launching units 1223. Among these factors are sound or other wave transmission speeds and distances (or probable, ranges thereof) from the projectile source to microphone/sensor 1215, the distance and signal transmission speeds between computer unit 1217 and unit 1215, the processing and transmission speeds and conduction distances for computer unit 1217 carrying out all operations necessary to process those signals and trigger media units 1223, the distance of the projectile from at least one media launching unit selected for launching media to intercept the projectile at the time of planned interception, and the launching acceleration and speeds (or probable, ranges thereof) of launched interception media along the planned path to intercept the projectile.

It should be understood that, although an embodiment using a single microphone or other sensor unit 1215 is shown, different sensors, such as cameras sensing electromagnetic radiation from a projectile (or other sensors), and image, image sequences or other sensory library and expression or characteristics recordings matched with projectiles and flight paths, may, alternatively, or in addition, be used by the ballistic protection system 1201 to assess a flight path or probably trajectory of a projectile, and plan interception with an interception media. In some embodiments, multiple sensors may be used, rather than the single sensor unit 1215 pictured. Embodiments with additional intake horns, additional differential media or sensors, or a actuable, moving sensor, although more expensive in some respects, may have other advantages, such as the ability to more rapidly and accurately assess a projectile location and trajectory (for example, implementing triangulation methods to determine the location of the projectile as a source of sound or other wave phenomena).

Media launching units 1223 comprise ballistic projectile interception media (or, in some embodiments, other projectile interception media), such as that shown deployed as 1221. Prior to deployment, such interception media is packed far more tightly in each of units 1223 than after launch, and held at a location within units 1223 outward from a propellant (such as a fast-burning, explosive solid fuel with integrated oxidizer, held deeper within units 1223). Preferably, a very fast-burning solid fuel or expanding gas is released, ignited, or otherwise triggered within launching units 1223 to propel and expand the interception media 1221, into a position such as that pictured. Thus, the computer unit 1217 is able to rapidly trigger and deploy projectile interception media 1221, expanding and launching it as shown by expansion/launch direction arrows 1220, and intercept bullet 1204, as shown at a secondary (intercepted) bullet position 1225.

Projectile interception media 1221 preferably takes the form of a folded blanket of ballistic projectile-resistant material, such as KEVLAR™. Also preferably, interception media 1221 resists the flow of air through it, in the forward direction (toward bullet 1204), and media 1221 also preferably comprises projectile path and attitude altering surface features, such as the structures and contours shown as 1227. Thus, as bullet 1204 collides with interception media 1221, bullet 1204's tip encounters and is pushed by one of such contours—namely 1229, causing the bullet 1204/1225 to pitch upward. Some of such contours—namely, outer catches 1260—are specialized for holding an intercepted projectile, and preventing its "running off" or otherwise escaping from the interception media altogether. Preferably, interception media 1221 also comprises kinetic energy dispersing and surface area widening sub-features and structures, such that media 1221 prevents or decreases damage to an object on the other side of it from a projectile it is intercepting, in the event of a collision. Also preferably, those sub-features and structures are flexible, and foldable, allowing media 1221 to be flexibly molded, but cause binding (e.g., with fibers that interlock in reaction to ballistic forces) to enhance that effect. Furthermore, the overall outline of the deployed media 1221 is curved, further causing bullet 1204 to be pushed lower, deviating downward from its initial flight path/trajectory 1205. Overall, these features, in conjunction with air resistance against media 1221, create a tumbling, kinetic energy-absorbing effect on bullet 1204 at position 1225, greatly decreasing its kinetic energy and lowering its flight path. It should be understood that media 1221 is pictured in a partial cross-section, for simplicity of illustration, and appears to be 2-dimensional as a result, but that, in a preferred embodiment, is 3-dimensional and covers a wide area surrounding the user. In that embodiment, media 1221 also curves inward, toward the user and butt of the firearm, as one proceeds upward, out of the page, also pushing an intercepted bullet away, and to the side of a user, in that direction. Similarly, although contours 1227 are shown in cross-section as 2-dimensional curves, it should be understood that they are preferably 3-dimensional, scooping contours, and grip, control and intercept a projectile colliding with it from a wide variety of directions, over a wide area.

The firearm pictured in the figure, and mounted ballistic protection device 1201, are in a configuration optimal for a left-handed user, such that the user's left hand may grip the handle of firearm 1203, and her left index finger may access control 1231. In addition, the launching units 1223 cover areas completely exposed to projectiles, with open air, whereas the right-hand side of the user is more naturally protected by the user's right arm, which normally would be placed on the forward grip of rifle 1203. Specialized launchers 1223 may also be included in device 1201, however, on the right-hand side of rifle 1203 and the user, with aimed launching, media shapes and resulting coverage matching areas not covered by the user's arm. This embodiment has the added benefit of avoiding errant collisions of the media 1221 with the user's forearm. It should be understood that the various coverage scenarios, mounting positions and sensor locations are exemplary only, and that a wide variety of alternative or additional scenarios, positions and locations may be implemented while carrying out aspects of the present invention. For example, one embodiment may have ground-mounted interception media launchers, and sensors placed several hundred yards forward from a user's position, while carrying out aspects of the present invention.

If, by contrast, the computer unit determines that bullet 1204 has a projected flight path that is higher than that pictured (e.g., with too high a probability of intersecting with a user's head, chest or shoulders), the upper unit 1223 may, instead, be deployed (not pictured). In that instance, the deployed media would take on a similar shape to that pictured as 1221, but with a much higher profile, facing upward more, and deflecting the flight path of the intercepted bullet upward, rather than downward.

In some embodiments, each launching unit 1223 may launch a series of layered intercepting media, with separately-triggered propellants. In these embodiments, the same device 1201 may be fired multiple times, intercepting several bullets presenting a danger for the firearm user, before a unit needs to be refurbished or replaced for further operation. In a preferred embodiment, units 1223 are interchangeable, and rapidly exchangeable, with touch-based electrical contacts that connect and disconnect simultaneously with fastening/unfastening mounting hardware for variably connecting them to the remainder of device 1201. In this way, a surplus of additional units 1223 may be kept on hand, and rapidly exchanged for depleted units 1223.

Although the example of a thin, tightly-packed blanket of ballistic projectile-resistant media 1221 is provided, it should be understood that a wide variety of different intercepting media may be used—alternately, or in conjunction. For example, in some embodiments, a balloon of media-holding a gas, rather than a blanket, may be launched, or a distributed liquid, sticky or malleable substance (such as glue) or field of loose particles may be launched, to intercept, reduce the kinetic energy of, sequester, widen and disperse the energy of and/or divert bullet 1204. In some such embodiments, launchers 1223 may project and collide with bullet 1225 predominantly laterally during interception, to primarily cause bullet 1225 to be diverted around a user, rather than attempt to absorb its energy primarily. In some embodiments, a force field, such as a magnetic field generated from a strong electromagnet rather than a launcher 1223, may be implemented to divert the bullet's flight path, rather than a physical media. In another embodiment, a smaller, intercepting projectile may be launched from one of, and/or part of launchers 1223, which may further comprise aiming actuators for altering the path of the intercepting projectile when it is launched, and computer unit 1217 may control those aiming actuators to cause the launched intercepting projectile to intercept, collide with and/or sequester bullet 1204 (based in part on a determination of bullet 1204's location, flight path and trajectory over time, as discussed above). The precise examples disclosed and set forth herein are preferred, but not exhaustive of the many possibilities, each of which may have some distinct advantages over others, that fall within the scope of the invention.

In the embodiments set forth above comprising an expanded blanket of interception media, a wide variety of different materials and designs may also be used. For example, some embodiments may implement extremely light and strong materials (such as KEVLAR™ or even graphene) while other embodiments may use a media that is not fully bullet-proof, but cheap to produce, and effective at diverting the paths of ballistic projectiles, and reducing their lethality.

To save energy, and to reduce the likelihood or impact of a false positive match between sound signals interpreted by the computer unit 1217, and library models, expressions or other recordings associated with a probable flight path of a projectile requiring protection of a firearm user, system activation controls 1231 and/or 1233 may be provided. System activation controls 1231 and/or 1233 enable a user to quickly and easily activate projectile-blocking ballistic protection device 1201, such that it able to carry out the sound or other wave interpretation, projectile flight path determination and/or projectile interception methods set forth in this application. Either or both of controls 1231 and 1233, or another form of system activation control, may be included, and any part of projectile-blocking ballistic protection device 1201 may be activated (by providing power, configuring or otherwise readying device to operate and intercept incoming projectiles posing a probable threat to the user) when a user actuates controls 1231, 1233 or such an other form of control. In a preferred embodiment, the entire device remains on standby, using no power or minimal standby power, unless and until a user depresses control 1231 (a button) with his or her index finger, or unless and until a user partially depresses firearm trigger 1232 or releases a firearm safety device. In any of those embodiments, device 1201 is activated on-demand, as the user encounters a potentially dangerous engagement scenario that may improve due to the use of the protection afforded by device 1201. For example, if a police officer is engaging an armed suspect who, although dangerous to the officer, has not yet fired a weapon, or threatened such deadly force warranting the officer's firing in self defense, the officer can still take measures to protect herself (and, in some embodiments in which launchers 1223 cover others near the firearm user) others from the possibility of such deadly force, by activating device 1201 while training her firearm at the suspect. If and when a suspect were to suddenly fire a firearm at the police officer, device 1201 then serves to protect the officer and, potentially, other persons, according to the methods discussed in this application.

System activation control 1231 is preferably isolated from firearm trigger 1232, but placed near enough to the natural placement of a user's index finger on firearm 1203 that it may be accessed without the user having to reposition his or her hand when holding firearm 1203's pistol-style grip. Thus, a user can rapidly activate device 1201 at any time, and move quickly between firing and protection options, using device 1201, and remain ready for multiple forms of necessary engagement. System activation control 1233 is even more easily, and, in a sense, passively engaged, under some circumstances. Activation control 1233 is mounted on or near trigger 1232 detecting when it is partially compressed, or when a finger is placed near it (e.g., on or within its trigger-guard), and, preferably, comprises a trigger movement detector. Thus, when trigger 1232 is partially depressed (for example, to release a trigger-mounted safety such as those used in GLOCK™ pistols), device 1201 and/or its computer unit or power supply (not pictured) may be powered on and engaged, or otherwise activated, to ready device 1201 and place it in a condition for operation. In this way, when a user applies pressure to trigger 1232, or otherwise indicates a likelihood of a deadly engagement, device 1201 becomes activated. In a preferred embodiment, system activation control 1233 is used in conjunction with a master activation switch (e.g., placed in the position of control 1231) and does not operate to activate device 1201 unless and until that master activation switch is first switched on. Even more preferably, such a master activation switch does not require constant active pressure to remain on, unlike preferred embodiments of control 1231, when used alone, which preferably do require active pressure, but remain active for a period following that pressure, for sustained user safety in the event of surprise events.

Figure 13:
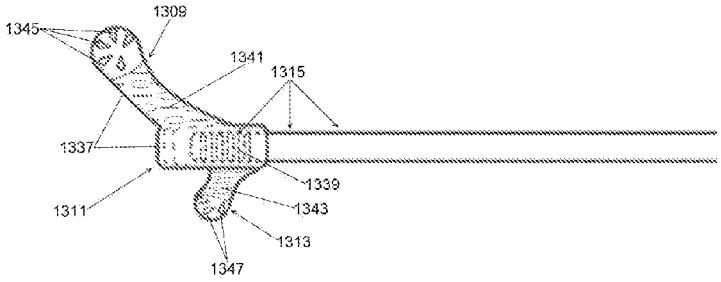
FIG. 13 is an enlarged view of an exemplary specialized, location-aiding microphone or sensor unit and headpiece of the protection device discussed with reference to FIG. 12.

FIG. 13 is an enlarged view of an exemplary specialized, location-aiding microphone or sensor unit 1315 and headpiece 1311 of the protection device discussed with reference to FIG. 12. As discussed above, in reference to FIG. 12, headpiece 1311 comprises at least two sound- or other wave-receiving horns: now shown as upper horn 1309 and lower horn 1313. Also as discussed above, headpiece 1311, and its horns 1309 and 1313, are at least partially hollowed out, as demonstrated by the limited thickness of housing 1337. This hollowed out design allows the insertion of microphone 1315 into, and the mounting of, headpiece 1311, with the added advantage of reduced weight and distinctive channeling of sound or other waves inside headpiece 1311 toward a diaphragm or other sensing instrument 1339 of microphone or sensor unit 1315, from the different horn/intake locations of horns 1309 and 1313.

As sound or other waves reach horn 1309 or 1313, they enter a space 1341 and 1343, respectively, via sound holes, 1345 and 1347, respectively. Space 1341 and 1343 may be differently contoured, lined, or filled with distinctive acoustic filtering materials, such that substantially the same originating sounds or other waves entering sound holes 1345 or 1347 may be distinguished as having passed through either space 1341 or 1343 after reaching sensing instrument 1339. For example, the larger shape and more gradual curve of space 1341, or different linings, in comparison to those of horn 1313, may yield a lower or otherwise different tone, echoes, or other reflections, or wave conduction, in comparison to the tones, reflections and conduction of space 1343. As another example, space 1341 may be filled with an acoustic material that mutes particular high-frequency sound waves, while space 1343 is filled with an acoustic filtration material that retains such high-frequency sound waves, while muting other frequency ranges. In this way, a computer system, such as the computer system embodiments discussed elsewhere in this application, receiving a signal from microphone or sensor unit 1315 is able to determine when the same originating sound or other wave reached horn 1309 and 1313, and, by comparing the sound or other wave patterns to models of projectile-emanating sound through the same headpiece 1311, the computer system may determine a probable location, velocity, and flight path for a projectile creating that sound or other wave. Those models may also reflect differing source locations, velocities and resulting flight paths, as determined by different conduction of sound from different source locations through the housing of horns 1309, 1313, and the regionally-varying housing thickness 1337 (and regionally varying shapes or materials, if used in a particular embodiment). By recording a library of different possible ballistic and other wave-producing projectiles under different atmospheric and other environmental conditions, such models may be built by recording, averaging, and deriving characteristics associated with projectiles of different types, traveling at different speeds, and with different trajectories—some of which may be identified by the computer system as threatening the safety of a user, for example, by endangering vital organs with a trajectory colliding with their likely location on a user of the ballistic protection system comprising microphone or sensor 1315. Alternatively, or in addition, a direct comparison and matching to recorded sound patterns in such a library may be carried out by control unit 1217, in other embodiments, to match up an associated probable projectile trajectory, and determine and carry out a safe deployment of an intercepting media or material, as discussed above.

Although the embodiment of a single microphone or sensor unit, with multiple, distinguishing pathways at different spatial positions, has been used, it should be understood that multiple microphones and/or sensors at multiple positions, and a wide variety of wave-detection or other detection sensors may, instead or in addition, be implemented in various particular embodiments. For example, embodiments may be implemented using a camera, or multiple cameras, (with or without an illuminator, but preferably with—e.g., using a LIDAR system) to observe an incoming projectile, and provide information to the control system such that it may plot a probable flight path for the projectile, determine if it poses an unacceptable risk to the user, and intercept it. In such an embodiment, there is the advantage of earlier information gathering and processing, because the electromagnetic radiation cast from the projectile moves at the speed of light, rather than the speed of sound.

Figure 14:
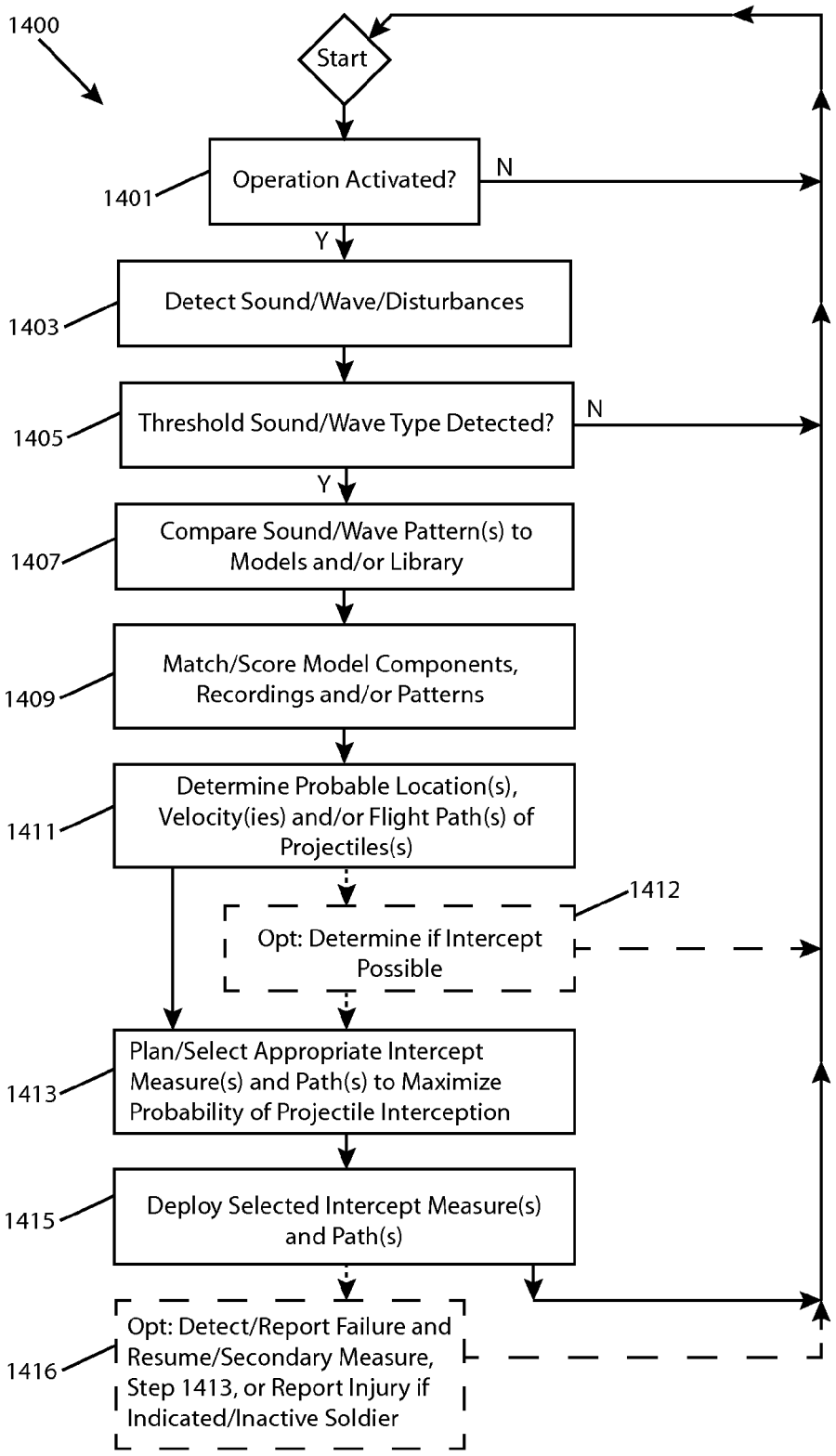
FIG. 14 is a process flow diagram depicting exemplary steps that may be executed by a control system implementing exemplary programming, methodology and other aspects of the present invention.

FIG. 14 is a process flow diagram depicting exemplary steps 1400 to be executed by a control system implementing exemplary programming, methodology and other aspects of the present invention, such as control system 1217 and/or 1800, discussed below, carrying out aspects related to projectile protection devices and methods. Beginning with step 1401, the system first determines, if possible (e.g., using a local power source), whether its operations have been activated, if a power source necessary for its operation has been connected, or if the associated projectile protection device has otherwise been configured to operate and intercept incoming projectile(s). For example, if a system activation control, such as control 1231 and 1233, have been actuated as described above, the control system may determine to activate further operations, receive power for operation, and/or determine to activate projectile interception-related operations. If those system operations have not been activated, or if the protection device has not otherwise been activated, the control system returns to the starting position.

If that activation has taken place, the control system proceeds to step 1403, in which it powers and/or receives signals from at least one microphone or other wave sensor (or, in some embodiments, other sensors), such as the main microphone or sensor unit and headpiece 1215 and 1211, or alternate embodiment projectile observational camera(s), discussed above. In some embodiments, in subsequent step 1405, the control system may pre-process that signal, to determine whether it exceeds a threshold or thresholds of characteristics indicating a potential danger from a projectile, warranting further processing. For example, if the signal does not indicate a sufficient wave amplitude emanating from a ballistic projectile, or near enough to the user to pose a danger, the system may determine that no further processing or consideration of the signal is then required, and return to the starting position. If the signal may indicate a potential danger from a projectile, however, the control system proceeds to step 1407, in which it compares the signal, or attribute or aspects of it or related to it, to models, characteristics or library recordings associated with particular or probable locations, velocities and/or flight paths of projectiles relative to a device comprising the control system. Next, the control system may match, or attempt to match the signal or attribute or aspects of it or related to it, to those models, characteristics or library recordings, in step 1409. Based on that matching activity, or on deductions from that matching (e.g., if similar enough to yield a possible projectile flight path or range of flight paths, create an average flight path associated with close matches) the control system may then determine and/or project probable location(s), velocity(ies) and/or flight paths (or a range thereof) of a detected projectile being tracked by the control system, in step 1411. In an optional step, 1412, the control system may then make a preliminary determination as to whether it is possible for the control system to intercept, divert or sequester the projectile using interception media, or other means of diversion, sequestration and interception set forth in this application, if present in the device comprising the control system. In that optional embodiment, the control system may return to the starting position if it determines that it is not possible to intercept, divert or sequester the projectile, thereby saving power or other resources and avoiding other undesired contingencies from further actions with respect to the projectile.

If the control system determines that it is possible to intercept, divert or sequester the projectile, or if step 1412 is omitted, the control system proceeds to step 1413, in which it proceeds to map, plan or otherwise select or determine intercept measures to be taken, and along what pathway, for example, by selecting an interception media launcher and launching interception media or other countermeasures, such as the ballistic interception media 1221, discussed above. The control system preferably selects such measures and paths to maximize the probability that a projectile will be intercepted, sequestered, diverted or otherwise rendered less harmful or less potentially harmful. Following that determination, the control system then proceeds to step 1415, in which it actuates, or causes the actuation of, the selected or determined intercept measures, according to the planned path(s). Finally, in some embodiments, the control system may carry out optional step 1416, in which the control system detects and/or reports any failure of the measures taken in step 1415, and may further deploy additional, supplemental measures to intercept, divert or sequester the projectile. In some embodiments, these measures may include spraying, coating or covering the user, or a part of the user's body projected to collide with the projectile, with a further interception media, further away from the projectile than the initial planned interception path and measures, buying more time by acting further along the projectile's path. Detection of such a failure may be made by a signaled or otherwise detected breach or failed collision with the projectile (e.g., by electromagnetic scan carried out by a LIDAR gun comprised in the control system and device), or by a breach of the soldier's uniform or body armor. The control system then returns to the starting position.

Figure 15:
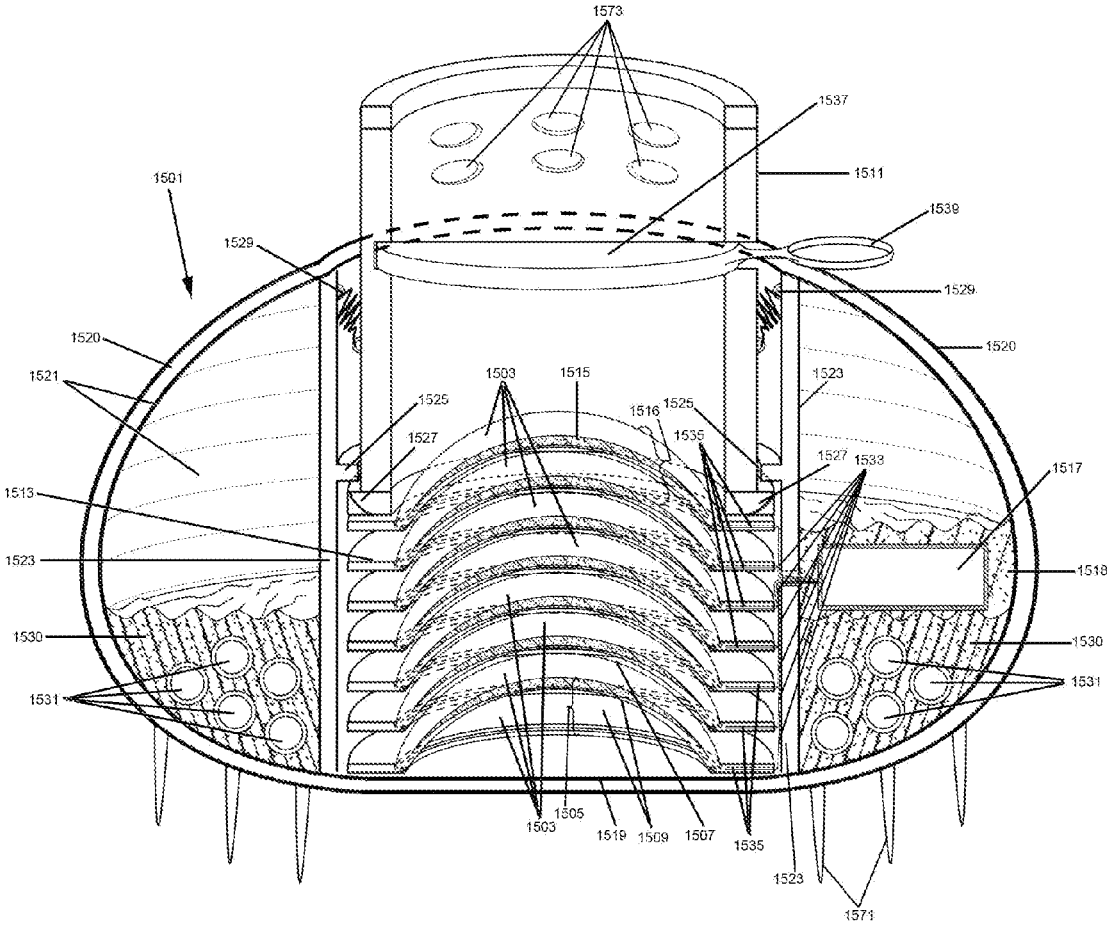
FIG. 15 is a cross-section depicting exemplary aspects of a portable, suppressive gunfire decoy device that may be planted or thrown by a soldier into a different location, to distract or confuse the enemy and/or to provide cover, with a simulation of gunfire.

FIG. 15 is a cross-section depicting exemplary aspects of a portable, suppressive gunfire decoy device 1501 that may be planted or thrown by a soldier into a different location than his own position, to distract or confuse the enemy, or to provide cover, with a simulation of his or her own, or similar gunfire. Generally, and as will be discussed in greater detail below, gunfire decoy 1501 is configured to fire several successive rounds of implanted, layered ammunition rounds 1503. Exemplary ammunition rounds 1503 differ from conventional ammunition in several important ways. Each round, as illustrated with exemplary round 1505, creates the curved, outer outline of a bullet on a leading surface 1507, but is substantially voided, inwardly-curved and/or (in some embodiments) hollowed out, as shown with exemplary trailing curved surface 1509. Preferably, as pictured, the shape of trailing curved surface 1509 is complementary, fitting the leading surface 1507 of a neighboring round of ammunition, if present. These attributes allow each round 1503, as it is fired upward out of a central, upward-pointed barrel 1511, to create sonic and visual effects similar to those of conventional ammunition (due to the bullet-shaped leading surfaces 1507), while greatly reducing weight and permitting the tight packing of many rounds of the ammunition 1503 in a single gunfire decoy 1501.

In the exemplary configuration pictured, 7 rounds of ammunition 1503 are pictured, stacked vertically. However, a wide variety of alternative amounts of ammunition and configurations of mock ammunition, such as 1503, may alternatively, additionally, be used in other particular embodiments. And, although ammunition units 1503 are pictured in a vertical, stacked configuration, a wide variety of alternative or additional configurations of ammunition may be used. For example, in some embodiments, ammunition 1503 may be packed in a side-by-side configuration with one another, in separate raised blisters on a single-layer substrate, and such substrates may be multiple, and layered. However, preferably, a vertical configuration such as that pictured is used, such that the leading edges 1507 better fit barrel 1511, creating a more realistic sonic and visual effect when fired. To increase that realism, a retaining collar of each round of ammunition 1503, such as the example shown as retaining collar 1513, which is part of the second-highest round of ammunition 1503, may be deformed, collapsing downward and forming extended sides when each round is fired, to better form the outline and dynamics of a bullet, while retaining each round within decoy 1501 and remaining flat-packed and consuming minimal space prior to firing.

Preferably, each round 1503 comprises an embedded explosive firing propellant, such as example 1515 within the top-most round 1516, and the propellant preferably has an integrated oxidizer. A computer unit 1517 coordinates and fires the rounds 1515, starting with top-most round 1516, and proceeding downward to each successive lower round for each subsequent firing. When detonated, propellant 1515 rapidly expands symmetrically, but encounters downward resistance due to the strong, arch-shaped leading surface 1507 of each round 1503, pressing against the base 1519 of decoy housing 1521 (and any rounds 1503 remaining below the fired round). To prevent lateral escape of any round pressed between a fired round and the base, rounds 1503 are preferably confined in a channel defined by structural members 1523. Structural members 1523 are preferably fastened to, or integral with, base 1519, and housing 1521, and may also comprise stays 1525, gripping a retaining collar of the barrel 1527, or is otherwise configured to hold barrel 1511 in place within the decoy, even when firing. The retaining collar of the barrel 1527 also may interface with and grip retaining collars of the ammunition, such as example 1513, holding them in place for firing, and aiding in deforming them, or causing them to break away from rounds 1503, depending on the embodiment, when they are fired. In some embodiments, the retaining collar of the barrel is rounded in a downward direction, to aid in its installation (and/or stays 1525 are rounded in an upward direction, for the same reason). Optional pushing springs 1529 are included in some embodiments, which aid barrel 1511 in traveling downward to interface with and hold rounds of ammunition 1503 as they are fired—particularly in embodiments where the retaining collars 1513 deform and exit decoy 1501 during firing, otherwise creating a void between barrel 1511 and ammunition 1503.

Computer unit 1517 is preferably powered by a local power source, such as exemplary battery cells 1531, through multiple, preferably redundant connections held in different places (not pictured), to reduce the probability of system failure caused by a single traumatic event. Battery cells 1531 are also preferably independently connected, and separately able to power, computer unit 1517, in case a subset of them fail. Power sources 1531 are also preferably distributed with radial symmetry, at or about the base 1519 of decoy 1501, such that their weight increases the likelihood that decoy device 1501 will remain upright (in the position pictured), after it is thrown to the ground. To hold battery cells 1531 in place, and cushion them from collisions as a result of decoy 1501 being thrown, dropped, and otherwise used, they may be immersed in a protective foam or other cushioning material 1530, which may be glued or otherwise fastened to base 1519 or other parts of housing 1521. Similarly, a protective foam or other cushioning material 1518, which is preferably less dense than material 1530, may encase, hold, and protect computer unit 1517. Material 1518 is preferably less dense and heavy both because computer unit 1517 may be lighter than batteries 1530, and to aid in encouraging decoy 1501 to right itself for operation after being thrown, as in the orientation pictured. Housing 1521 also comprises rounded exterior edges 1520 such that, if dropped upside down from the orientation pictured, it may easily roll and rotate into the orientation pictured. The differential weight of the foam and the weight of battery cells 1531 may be sufficient to guarantee the right orientation, pictured, in the vast majority of circumstances, but additional rounding and differential weighting—as by the addition of more bottom weights, for example, within foam 1530, or in place of some of battery cells 1531—may also be used. In addition, the first round of ammunition fired from barrel 1511 may aid in causing decoy 1501 to jump off of an errant, upside-down position. In a preferred embodiment, all weighting at or about base 1519 (or, at least, below the geometric or spatial center of decoy 1501) is enough to exceed all weighting above the geometric or spatial center of decoy 1501 (including such items as barrel 1511). In some embodiments, barrel 1511 may be made of a lightweight, but strong material or design (e.g., hollowed out metal, or ballistic plastic) also to encourage decoy 1501 to right itself when thrown.

Computer unit 1517 is connected to electrical detonating leads or wires 1533, and detonators 1535. Each lead or wire 1533 connects to just one detonator 1535, and Leads or wires 1533 are preferably electrically insulated and protected with multiple layers of bullet-proof sheathing, to prevent signal cross-over between leads after trauma. To prevent injury in the event of the accidental detonation, however, of any of rounds 1503, a user-removable blast shield 1537 may be included, and, in a preferred embodiment, its removal (e.g., via pulling loop 1539) may trip a switch that activates computer unit 1517, and decoy 1501 generally. In some embodiments, blanks, rather than live rounds as pictured, of ammunition may be used, in which no projectile is fired through barrel 1511. In such embodiments, a blast shield 1537 may be omitted, but preferably is not, even in those embodiments. In any event, computer unit 1517 is generally configured to provide an electric charge powerful enough to detonate detonators 1535, implanted in or near propellant, such as 1515, in rounds 1503 to detonate and fire them in a sequence, one at a time, from upper-most round 1515, downward, according to a firing schedule, which may be dictated by a user and/or programmed into computer unit 1517. However, in some embodiments, a different order, or even a simultaneous detonation of rounds may be used, for example, to simulate larger gunfire explosions, or larger explosions than generally associated with gunfire (e.g., to simulate bomb detonations, in a Bomb mode, which will be discussed in greater detail below).

Thus, a general method of using decoy 1501 may include the steps of selecting a personnel location, selecting a different location for decoy 1501, removing shield 1537 by pulling loop 1539, activating device 1501, and throwing (preferably in the same manner as a Frisbee) device 1501 to that different location. At that point, computer unit 1517 may follow a pre-programmed detonation routine, using a timing circuit, and may further comprise a continuously run or externally synchronized clock, to carry out a firing routine according to a schedule based on a universal, or external time schedule.

In some embodiments, the firing routine may be random, stochastically generated, and/or distributed over a pre-ordered or later-determined or communicated time frame. In the latter embodiment, computer unit 1517 may comprise a means for wireless or other communication, such that a user with a transmitter may command the computer unit 1517 to begin a firing routine, or even to execute individual rounds, bursts or sequences of firing immediately. In a preferred embodiment, decoy 1501 is equipped with seismic sensors and/or microphones, and is configured to detect and be triggered by sounds resembling local gunfire or other troop operations—for example, using the ballistic projectile detecting methods discussed above, with reference to FIGS. 12-14. Upon so detecting the initiation of a battle, the decoy may rapidly respond with its own fire, but preferably distributes its firing routine over at least a 5 minute interval, to maintain its distracting capabilities, and drawing enemy fire, for the longest possible time. However, in several embodiments discussed in this application, and, in particular, in relation to user settings created with a control device set forth below, users may select any of several Delay and Interval settings, to suit their objectives.

To distinguish decoy fire from real live fire, soldiers may be informed in advance, or receive notices from a larger system comprising decoys such as 1501, identifying decoy firing as decoy firing, and relating or demonstrating the location of such decoy firing.

To aid in planting device 1501 during firing, spikes or other ground grips 1571 may be included in some embodiments. To reduce visible flash, flash suppressing holes 1573 may also be included in some embodiments but, preferably, they are not included to create a visible location of decoy gunfire with a pronounced muzzle flash.

Figure 16:
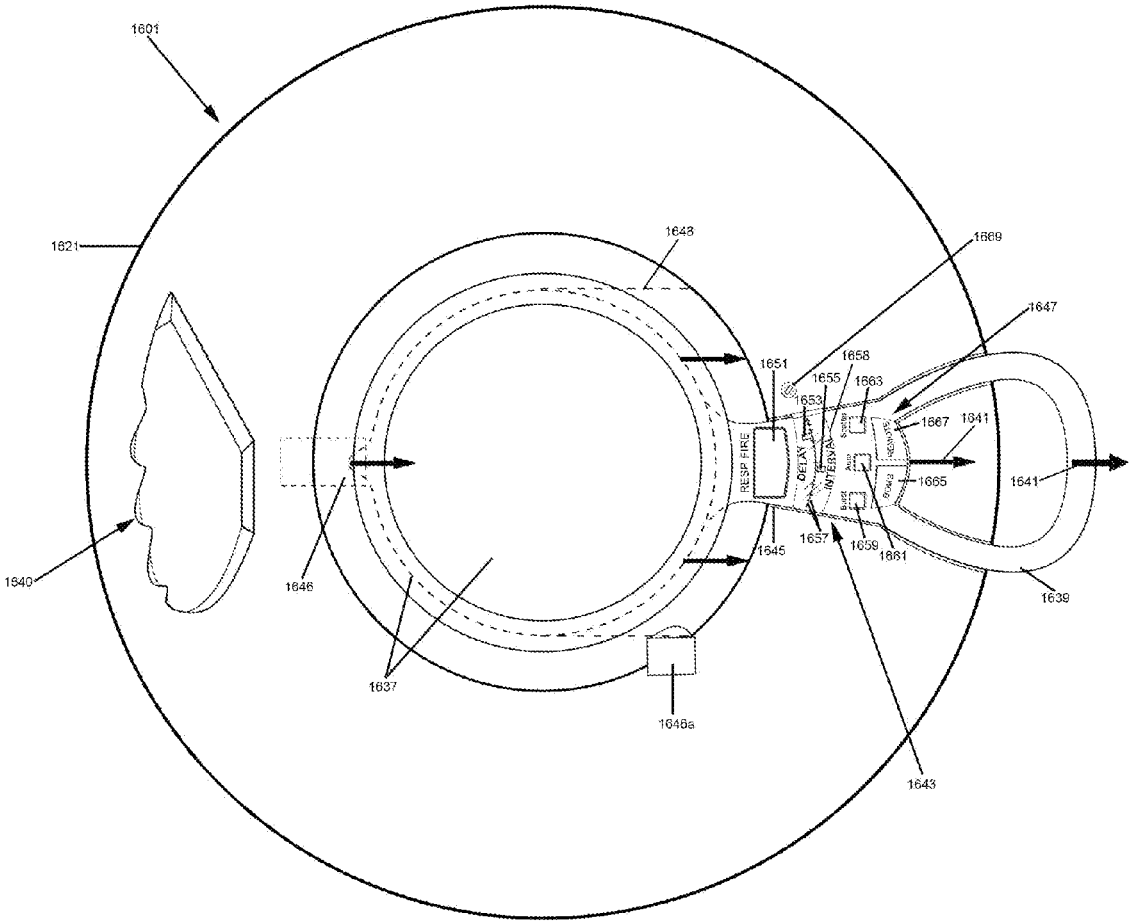
FIG. 16 is a top-view depicting additional aspects of a portable suppressive gunfire decoy device similar to the device discussed with reference to FIG. 15, above.

FIG. 16 is a top-view depicting additional aspects of a portable suppressive gunfire decoy device 1601, similar to the device discussed with reference to FIG. 15, above. As with device 1501, device 1601 may be planted or thrown by a soldier into a different location than his or her own position, to distract or confuse the enemy, or to provide cover, with a simulation of his or her own, or similar gunfire. To aid in throwing it, and in transporting it, a grabbing handle 1640 is included in some embodiments.

But prior to so throwing device 1601, a user may take several steps to program and configure device 1601 for operation, using general user interface and pull-pin control device 1643. As with loop 1539, discussed above, pull-pin control device 1643 may be removed, by pulling its handle 1639 in the direction shown by motion arrows 1641, triggering the activation of the decoy device 1601 and its embedded computer unit (not pictured in the present figure, but within housing 1621). More specifically, as handle 1639 is so pulled, all of device 1643, which is connected to or integral with it, is withdrawn with it, in the same direction, from a complementarily-shaped cutaway or seat 1645 within housing 1621. In addition, because device 1643 is also connected to or integral with blast shield 1637, blast shield 1637 is simultaneously withdrawn from firing barrel 1611, through a barrel slot 1648, opening barrel 1611 for firing rounds of ammunition (or, in some embodiments, blanks) through it. Blast shield 1637 may be connected to a switch 1646 (and/or 1646*a*) such that, as it is so withdrawn, the switch triggers a computer unit of decoy device 1601 (such as computer unit 1517) to activate decoy device 1601, as will be discussed further with reference to FIG. 17.

As also will be discussed with reference to FIG. 17, below, control device 1643 comprises a set of user interface controls 1647, which aid in configuring device 1601 for deployment and, in some embodiments, may be used to remotely control device 1601. In such embodiments, both control device 1643 and decoy device 1601 may each comprise local computer units, power sources and communications equipment (e.g., wireless transmitter/receivers), preferably configured for encrypted and otherwise secure communications. Whether or not such a remote control embodiment is implemented, prior to removal, when pull-pin control device 1643 is seated in housing 1621 (as pictured) it is preferably connected via communications wiring with a computer unit comprised within the remainder of device 1601, such as computer unit 1517. This hard-wired connection is preferably maintained using soft contacts on the outer surface of housing 1621, within seat 1645, and complementary contacts on the outer surface of control device 1643. As this hard-wired connection is maintained, a user is able to program and configure device 1601, using interface controls 1647 and that communications connection, and control device 1643 may be powered by power sources resident in the remainder of device 1601, via that same connection.

User interface controls 1647 comprise several buttons and sliders for user input, and configuring, creating settings for and programming device 1601. By depressing Responsive Fire button 1651, a user configures device 1601 to initiate a Responsive Fire mode, once device 1601 is activated, which causes device 1601 to sense when enemy gunfire occurs at a sufficient proximity (e.g., source determined to be within 50 meters), and, if so, to respond with its own mock gunfire or explosions, or a particular pattern or sequence of gunfire or explosions selectable by a user, as will be discussed in greater detail below. In some embodiments, device 1601 so senses enemy gunfire by implementing a microphone or other wave sensor (such as microphone or sensor 1315, and its methods for detecting proximate sound and other wave sources, discussed above). In embodiments in which device 1643 is used as a remote control unit (discussed in greater detail, below) button 1651 may also be used to immediately initiate firing by device 1601, preferably, by holding down button 1651 for more than 1 second when device 1643 is separated from housing 1621. Delay slider 1653 and Interval Control slider 1655, respectively, permit a user to set the length of time (1) before initiating, and (2) between, mock gunfire shots (or bursts), preferably with the aid of an attached slide-manipulated potentiometer. Preferably, the scale for those time settings is represented by a non-scalar timeline represented by the groove in which sliders 1653 and 1655 travel, with positive stops indicated by tick marks, such as the examples shown as 1657. For example, the first tic mark (lowest down on the figure, and most left-ward while reading the writing on interface controls 1647) may represent a setting of 0, signifying that if the Delay slider 1653 is set at that position upon deploying device 1601, the user will cause 1601 to initiate gunfire with no delay (or with a minimum delay, implemented in every case for safety purposes). Similarly, if Interval slider 1655 is set to that first, "0" tic position, device 1601 will fire shots or patterns at instances separated by a minimum amount of time separating them, once device 1601 is activated. The second and third tics upward (or from the left, when reading interface controls 1647) may signify time settings of 30 seconds and 2 minutes, respectively, causing those amounts of time to be implemented if either slider control is placed at them. The third setting may correspond with a time setting of 15 minutes, and the fourth tic may correspond with 30 minutes. The fifth (central) tic may correspond with a time setting of 1 hour. The final four tic marks preferably continue to accelerate by a non-scalar algorithm, yielding a 3-hour setting for the sixth tic, a six-hour setting for the seventh tic, a 12-hour setting for the eight tic, and a 24-hour setting for the ninth tic. Positions in between the tics preferably evenly divide the difference in time between tic settings, however. In this way, the sliders 1653 and 1655 may be set at a wide variety of time settings, covering a long period, but with special emphasis and granularity provided for more frequently-used time settings (e.g., shorter time settings). Sliders 1653 and 1655 are preferably variably enclosed behind a removable see-through door 1658. Thus, a user can open door 1658, carefully make time setting selections with sliders 1653 and 1655, and then close door 1658 over them, ensuring that they will not be inadvertently bumped or otherwise errantly altered after setting and prior to deployment of device 1601. In some embodiments, such a door 1658 may be placed over all of controls 1647, to similarly protect settings related to all of them. And because door 1658 is clear, a user can still check settings, visible through door 1658, at any time.

Proceeding rightward on the face of user interface controls 1647, a staggered row of buttons next presents: Burst setting button 1659, Automatic firing button 1661, and Random/Scatter button 1663. As with all other buttons of user interface controls 1647, each of buttons 1659-1663 preferably retains a visible activated and/or depressed position (conditioning or configuring the operation of device 1601, as will be discussed in more detail below) when pressed once, and each returns to a raised, inactive position when pressed a second time. When so pressed a single time, and activated, Burst Setting Button 1659 causes decoy device 1601 to perform firing instances (subject to other operative settings and conditions set forth herein, including activation and deployment of device 1601, delay settings, and responsive fire settings) as a burst of multiple rounds (e.g., 2, 3 or 4 rounds, or other burst mode groupings for firearms subject to imitation by device 1601, or known in the art), fired in rapid succession, with minimal pause in between them, or a small, randomized pause between them), rather than as a single shot, with such bursts treated as a single round of ammunition would be with respect to all other user-variable settings discussed herein. Automatic firing button 1661, when pressed a single time and activated, causes device 1601 to perform firing instances as a longer, continuous string of fired rounds than that set forth subject to a Burst Mode—again subject to the activation and deployment of device 1601, and other operative settings and conditions set forth herein. Preferably, Button 1661, if depressed and activated, overrides any Burst mode setting caused by simultaneously depressing and activating Burst button 1659. Scatter button 1663, when pressed a single time and activated, causes device 1601 to randomly or algorithmically alter the interval between rounds (or burst or automatic firing groups of rounds), while maintaining an average interval according to any setting selected with slider 1655. In this way, device 1601 may simulate a source of live fire more realistically, than with uniform intervals.

Finally, proceeding rightward on the face of user interface controls 1647 farther, two larger push buttons are present: Bomb mode button 1665 and Remote mode button 1667. Bomb mode button 1665, if pressed a single time and activated, causes device 1601 (subject to other operative settings and conditions set forth herein, including activation and deployment of device 1601, delay settings, and responsive fire settings) to fire more than one round of ammunition simultaneously (or nearly simultaneously, with a separating interval imperceptible by a human observer or audience), or to fire a larger explosive (in embodiments not pictured in the present application) than the explosives within rounds associated with simulating gunfire. Remote mode button 1667, if pressed a single time and activated, causes device 1601 to initiate a remote mode of operation, in which device 1601 may be operated via wirelessly-transmitted command signals from a remote control unit. In some embodiments, as discussed elsewhere in this application, general user interface and pull-pin control device 1643 may comprise an antenna, dedicated power supply, and computer system, enabling it to operate as such a remote control device when separated from the remainder of device 1601, and each of the user input and control aspects discussed above will continue to be operable, controlling the operation of device 1601 remotely. In such embodiments, however, an additional display resident on device 1643 is preferably included to relay information concerning the operation and status of device 1601. In other embodiments, another separate computer system, such as a laptop computer, or other personal computer system, connected in a common wireless network with device 1601 may, instead, be used to remotely control all settings and operations set forth above. For example, the GUI of a smartphone or laptop computer may present representations of each control set forth above, and even present more complex "if, then" programming options, based on an unlimited number of triggering events (e.g., tracked troop movements, calendared events that elapse). In addition, such a separate computer unit may display complex status indicators, and may, in some embodiments, relay intelligence that may be gathered by device 1601. In such embodiments, device 1601 may further comprise intelligence-gathering sensors and file storage, and transmit intelligence to a remote control unit or computer system, or another, e.g., central command, computer system. Such sensors may include cameras and antennas, for observing the enemy and intercepting enemy communications, enhanced by the resident computer unit (e.g., recognizing enemy materiel and foot soldiers, and providing counts thereof to the remote control or computer system.

Control device 1643, or another part of device 1601, may also comprise aspects for displaying information related to the state of, and activities related to, device 1601. For example, an alert light 1669 may be provided in some embodiments, and may flash one color (e.g., yellow) to indicate a low battery condition for the power source(s) supplying power for device 1601. Alert light 1669 may flash another color (e.g., red) to indicate that device 1601 has been activated (e.g., by remote control command, or by separating pull-pin control device 1643). Alert light 1643 may also flash another color (e.g., green) to indicate that it is sufficiently powered and/or presently being programmed, as a user provides input through any of the user controls discussed above. But more complex—e.g., liquid crystal, GUI displays—may also, or alternatively, provide any such status information, and, in some embodiments, may also represent GUI controls, such as any of the controls 1647, discussed above.

Figure 17:
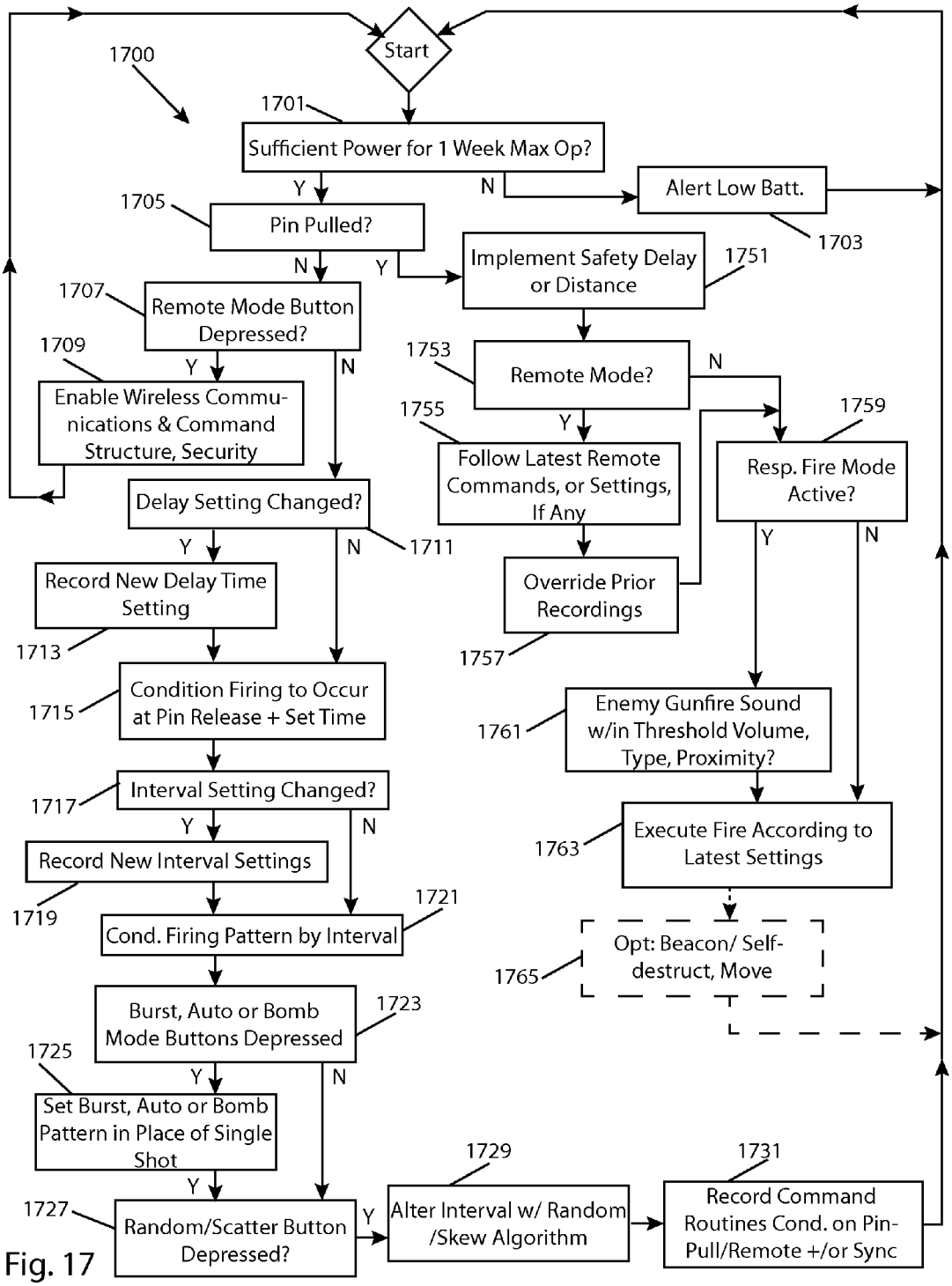
FIG. 17 is a process flow diagram depicting exemplary step to be executed by a control system implementing exemplary programming, methodology and other aspects of the present invention related to a suppressive gunfire decoy device, such as devices discussed with respect to FIGS. 15 and 16, above.

FIG. 17 is a process flow diagram depicting exemplary steps 1700 to be executed by a control system, such as control system 1517, implementing exemplary programming, methodology and other aspects of the present invention related to a firing decoy device, such as devices 1501 and 1601. Beginning with step 1701, the system first determines whether there is sufficient power, for example, from local power source or battery cells 1531, discussed above, to effectively power such a device 1501/1601 for its intended operations, some of which will be discussed in further detail below. Preferably, the control system specifically assesses whether the local power source has sufficient stored power to run required, or potentially required, operations of device 1501 or 1601 (whichever is applicable) for a required operational period, such as 1 week at the highest possible energy usage, as stated in the figure. If, at step 1701, the control system determined that there was insufficient stored power to run required, or potentially required, operations of device 1501 or 1601, it may issue an alert regarding that low-power condition, for example, by sending a wireless signal, or by causing light 1669 to flash yellow, in step 1703. If there is such sufficient power, the control system proceeds to step 1705, in which it determines whether a pull-pin device (such as pull-pin 1539 or 1643, of device 1501 or 1601, respectively) or another system activation device has been pulled or otherwise actuated and, in some embodiments, further determines whether device 1501 or 1601 has been deployed following activation. If so, the control system proceeds to steps 1751 et seq., which will be discussed in greater detail below. (In some embodiments, deployment may be separately assessed after activation, by accelerometers indicating that device 1501/1601 has been thrown and landed.)

If not, however, the control system proceeds to step 1707, in which it determines whether the Remote mode button (such as that discussed above as 1667) has been depressed. If so, the control system proceeds to step 1709, in which it enters a remote control operations mode, and, as discussed above, may have any and all of its user-variable settings and commands set by remote control (e.g., via a separately-powered, detached and wirelessly networked general user interface and pull-pin control device 1643). If, at step 1707, the Remote mode button is not depressed, the control system proceeds to step 1711, in which it determines whether (e.g., via an associated potentiometer) the slider control for a firing Delay setting (such as slider 1653) has been adjusted. If so, the control system detects and records the new delay setting, for example, in an enclosed optical or flash memory hard drive, in step 1713. In step 1715, the control system also may condition firing to occur only when the system has been activated, plus the amount of Delay time indicated by the recorded time setting from step 1713—for example, by initiating a timer, or timer programming, delay prior to any detonation, using an internal clock, once operations for device 1501/1601 are activated (for example, by pulling pin 1539 or pin-pull device 1639). Thus, when activated and deployed, device 1501/1601 will not commence firing until the recorded delay time (plus an optional minimum safety time) has elapsed following that activation and/or deployment. (As mentioned above, in some embodiments, deployment may be separately assessed after activation, by accelerometers indicating that device 1501/1601 has been thrown and landed. This aspect may also be applied to conventional thrown explosive devices, such as hand grenades.) The control system next determines whether (e.g., via an associated potentiometer) the slider control for a firing Interval setting (such as slider 1655) has been adjusted, in step 1717. If so, the control system detects and records the new delay setting, for example, in an enclosed optical or flash memory hard drive, in step 1719. In step 1721, the control system may condition firing to occur (upon activation and/or deployment, and the elapse of any delay, discussed above) by intervals separating gunfire or bursts of gunfire that match the recorded interval time, using a timing device or programming discussed above.

Next, the control system proceeds to step 1723, in which it determines whether any of the Burst fire mode, Automatic fire mode or Bomb mode buttons—such as buttons 1659, 1661 and 1665, respectively—have been depressed. If so, in step 1725, the control unit may establish and set a condition for firing to occur in accordance with those settings (as discussed elsewhere in this application) replacing a single shot fired with a burst, automatic fire, or bomb-mimicking explosions, upon activation and deployment of device 1501 or 1601. In a preferred embodiment, activation and firing is also conditioned on an accelerometer determining that a sufficient deceleration has occurred after pin 1639 is pulled—for example, a lateral deceleration exceeding a threshold, or taking place after an abrupt acceleration corresponding with being thrown.

Following step 1725, or after proceeding directly from step 1723, the control system next determines whether the Random/scatter mode button (such as button 1663) has been depressed in step 1727. If so, the control system proceeds, in step 1729, to randomly (or by another dispersing or skewing algorithm) alter the planned intervals between gunfire (or bursts thereof, if applicable), while maintaining an average interval equal to the interval time setting, discussed in steps 1717 et seq., above. Finally, before returning to the starting position, the control system may record all of the above settings, as set by a user, in an execution plan or set of operation routines, which will be carried out upon activating and/or deployment of device 1501 or 1601—i.e., after a user pulls out pin 1539 or device 1643 and throws device 1501 or 1601, as sensed by the control system—in step 1731.

If pin 1539 or device 1643 is pulled out and device 1501 or 1601 is activated and/or deployed, in step 1705, the control system may proceed to step 1751, in which it delays initiating and implementing the set operation routines (according to settings or programming by a user in steps 1707 et seq., if any) until a minimum amount of time has elapsed, and/or a minimum distance from the user, or, in some embodiments, impact after throwing, has been achieved. This step is included to ensure a safe operation of device 1501 or 1601, in which firing or other explosions do not occur too close to the user. The control system then proceeds to step 1753, in which it determines whether device 1501 or 1601 has been configured for Remote operation (in steps 1707 and 1709, as discussed above). If so, the control system proceeds to follow any commands or settings communicated to it via a remote control (e.g., by wireless transmission methods, as discussed above), in step 1755. If any such commands and settings have been so received, the control system overrides any prior, conflicting commands or settings, replacing them—for example, which may have resulted from prior remote control transmissions or settings and programming resulting from steps 1707 et seq.—in step 1757. Following that step, or, if applicable, after directly proceeding from step 1753, in step 1759, if Remote mode has not been selected, the control system next determines whether device 1501 or 1601 has been configured or programmed to enter a Responsive Fire mode and, if so, activates a microphone or other sensor present in device 1501 or 1601 and monitors sound or other waves indicating nearby enemy gunfire, or gunfire matched to records for gunfire of a particular type, or volume. If such gunfire (e.g., determined to match a particular type of firearm, or to originate within a set distance or with a great enough volume, such as 50, 100 or 500 meters, or greater than 50, 80 or 100 decibels) is detected, in step 1761, the control system then initiates a firing routine in response, in accordance with other user settings, in step 1763. Alternatively, if the Responsive Fire mode has not been activated, the control system proceeds to step 1763 directly from step 1759, and carries out a firing routine in accordance with the latest recorded settings (from remote control or configuration and programming in steps 1707, et seq.). Finally, in optional step 1765, the control system may signal when it has completed its firing (e.g., when its ammunition is depleted, or after a maximum time setting), or may self-destruct or initiate movement of device 1501 or 1601, using movement actuators to avoid location and capture by an enemy. The control system then returns to the starting position.

Figure 18:
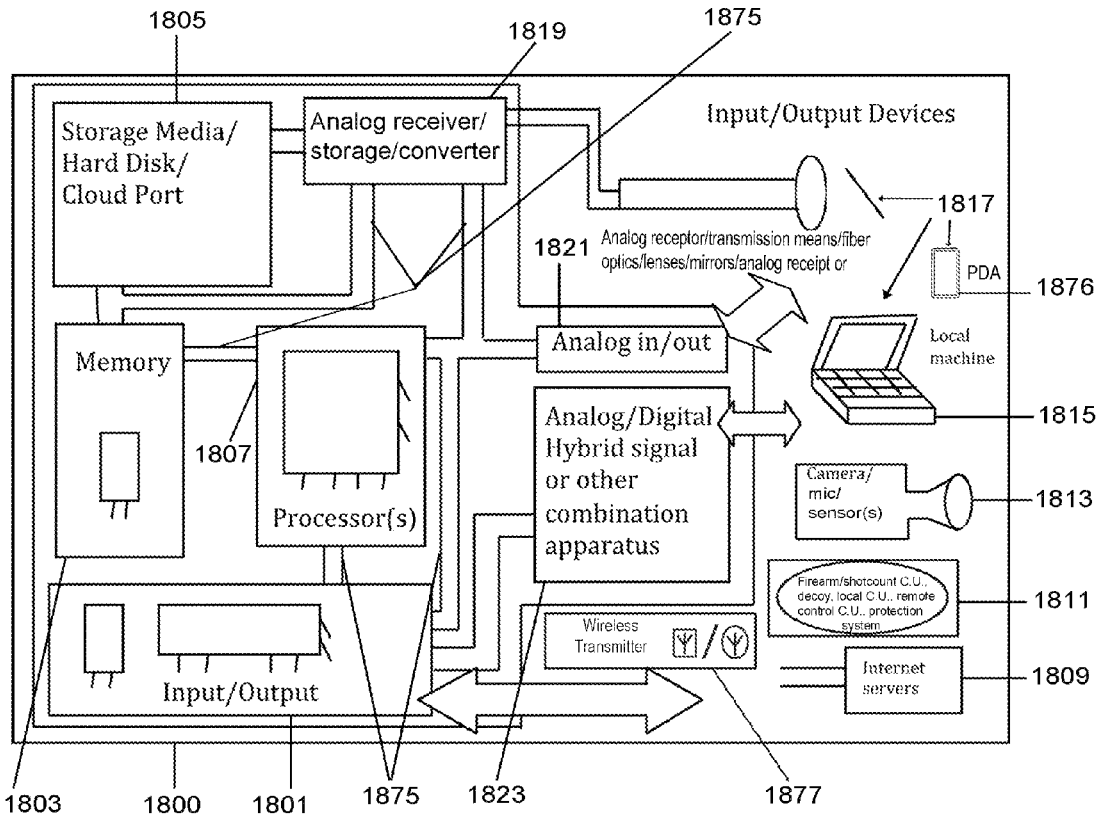
FIG. 18 is a schematic block diagram of some elements of an exemplary control system that may be used in accordance with aspects of the present invention.

FIG. 18 is a schematic block diagram of some elements of an exemplary control system 1800 that may be used in accordance with aspects of the present invention, such as, but not limited to, controlling shot-counting and multiple magazine engagement systems, or controlling a projectile protection system and the deployment of interception media, or controlling gunfire decoy devices and remote control user interfaces.

The generic and other components and aspects described herein are not exhaustive of the many different systems and variations, including a number of possible hardware aspects and machine-readable media that might be used, in accordance with the present invention. Rather, the system 1800 is described to make clear how aspects may be implemented. Among other components, the system 1800 includes an input/output device 1801, a memory device 1803, storage media and/or hard disk recorder and/or cloud storage port or connection device 1805, and a processor or processors 1807. The processor(s) 1807 is (are) capable of receiving, interpreting, processing and manipulating signals and executing instructions for further processing and for output, pre-output or storage in and outside of the system. The processor(s) 1807 may be general or multipurpose, single- or multi-threaded, and may have a single core or several processor cores, including, but not limited to, microprocessors. Among other things, the processor(s) 1807 is/are capable of processing signals and instructions for the input/output device 1801, analog receiver/storage/converter device 1819, analog in/out device 1821, and/or analog/digital or other combination apparatus 1823 to cause a display, light-affecting apparatus and/or other user interface with active physical controls, such as indicator buttons and displays, and control actuation and other monitoring hardware, any of which may be comprised or partially comprised in a GUI, to be provided for use by a user on hardware, such as a specialized personal computer monitor, remote control device or PDA (Personal Digital Assistant) or control unit screen (including, but not limited to, monitors or touch- and gesture-actuable displays) or a terminal monitor with a mouse and keyboard or other input hardware and presentation and input software (as in a software application GUI), and/or other physical controls, such as buttons, sliders, knobs, LEDs or LCDs. Alternatively, or in addition, the system, using processors 1807 and input/output devices 1819, 1821 and/or 1823, may accept and exert passive and other physical (e.g., tactile) user, power supply, appliance operation, user activity, circuit and environmental input (e.g., from sensors) and output.

For example, and in connection with aspects of the invention discussed in reference to other figures set forth in the present application, the system may carry out any aspects of the present invention as necessary with associated hardware and/or using specialized software, including, but not limited to, controlling actuators for engaging and monitoring numerous magazines relative to a single firearm, operating a shot-counting or other ammunition inventory system, controlling ballistic projectile interception media launchers, controlling gunfire decoy devices, and operating wireless communications hardware to establish remote control. The system may also, among many other things described for control systems in this application, respond to user, sensor and other input (for example, by a user-actuated GUI controlled by computer hardware and software or by another physical control) to issue alerts, alter settings (such as perimeter distances, sound volumes and source proximities leading to reactive fire and other factors triggering firearm decoy detonations or ballistic protection), control alarms and alerts associated with operative conditions, authenticate users or remote control devices and give and receive instructions and commands to other devices and users, or perform any other aspect of the invention requiring or benefiting from use of a control system. The system 1801 may permit the user and/or system-variation of settings, including but not limited to the effects of user activity on modes of operation of the system, and send external alerts and other communications (for example, to users or other administrators) via external communication devices, for any control system, remote control or other control unit aspect that may require or benefit from such external or system-extending communications.

The processor(s) 1807 is/are capable of processing instructions stored in memory devices 1803 and/or 1805 (and/or ROM or RAM), and may communicate with any of these, and/or any other connected component, via system buses 1875. Input/output device 1801 is capable of input/output operations for the system, and may include/communicate with any number of input and/or output hardware, such as a computer mouse, keyboard, entry pad, actuable display, networked or connected second computer or processing device, control unit, other GUI aspects, camera(s) or scanner(s), sensor(s), microphone(s), sensor/motor(s), actuable electronic components (with actuation instruction receiving and following hardware), RF antennas, other radiation, wave or electrical characteristics reading, monitoring, storage and transmission affecting hardware, as discussed in this application, range-finders, GPS systems, receiver(s), transmitter(s), transceiver(s), transflecting transceivers ("transflecters" or "transponders"), antennas, electromagnetic actuator(s), mixing board, reel-to-reel tape recorder, external hard disk recorder (solid state or rotary), additional hardware controls (such as, but not limited to, buttons and switches, and actuators, current or potential applying contacts and other transfer elements, light sources, speakers, additional video and/or sound editing system or gear, filters, computer display screen or touch screen. It is to be understood that the input and output of the system may be in any useable form, including, but not limited to, signals, data, commands/instructions and output for presentation and manipulation by a user in a graphical user interface "GUI". Such a GUI hardware unit and other input/output devices could, among other things, implement a user interface created by non-transitory machine-readable means, such as software, permitting the user to carry out any of the user settings, commands and input/output discussed above, and elsewhere in this application.

1801, 1803, 1805, 1807, 1819, 1821 and 1823 are connected and able to communicate communications, transmissions and instructions via system busses 1875. Storage media and/or hard disk recorder and/or cloud storage port or connection device 1805 is capable of providing mass storage for the system, and may be a computer-readable medium, may be a connected mass storage device (e.g., flash drive or other drive connected to a U.S.B. port or Wi-Fi) may use back-end (with or without middle-ware) or cloud storage over a network (e.g., the internet) as either a memory backup for an internal mass storage device or as a primary memory storage means, and/or may be an internal mass storage device, such as a computer hard drive or optical drive.

Generally speaking, the system may be implemented as a client/server arrangement, where features of the invention are performed on a remote server, networked to the client and facilitated by software on both the client computer and server computer. Input and output devices may deliver their input and receive output by any known means of communicating and/or transmitting communications, signals, commands and/or data input/output, including, but not limited to, input through the devices illustrated in examples shown as 1817, such as 1809, 1811, 1813, 1815, 1876 and 1877 and any other devices, hardware or other input/output generating and receiving aspects—e.g., a PDA networked to control a control unit 1877 with the aid of specialized software (a.k.a. a "PDA Application" or "App."). Any phenomenon that may be sensed may be managed, manipulated and distributed and may be taken or converted as input or output through any sensor or carrier known in the art. In addition, directly carried elements (for example a light stream taken by fiber optics from a view of a scene) may be directly managed, manipulated and distributed in whole or in part to enhance output, and radiation or whole ambient light or other radio frequency ("RF") information for an environmental region may be taken by a photovoltaic apparatus for battery cell recharging if battery power is included as the power source for the control system, or sensor(s) dedicated to angles of detection, or an omnidirectional sensor or series of sensors which record direction as well as the presence of electromagnetic or other radiation. While this example is illustrative, it is understood that any form of electromagnetism, compression wave or other sensory phenomenon may become such an "ambient power" source harnessed to power the operations of a control unit and/or control system and/or may include such sensory directional and 3D locational or other operations-identifying information, which may also be made possible by multiple locations of sensing, preferably, in a similar, if not identical, timeframe. The system may condition, select all or part of, alter and/or generate composites from all or part of such direct or analog image or other sensory transmissions, including physical samples (such as DNA, fingerprints, iris, and other biometric samples or scans) and may combine them with other forms of data, such as image files, dossiers, appliance-identifying files, or operations-relevant recordings, or metadata, if such direct or data encoded sources are used. In addition to keys, codes entered into a GUI, fob, remote control or beacon signals, authentication aspects of the present invention may also or alternatively be carried out with biometric challenge and detection hardware, such as fingerprint, iris, DNA or other pattern scans While the illustrated system example 1800 may be helpful to understand the implementation of aspects of the invention, it should be understood that any form of computer system may be used to implement many control system and other aspects of the invention—for example, a simpler computer system containing just a processor (datapath and control) for executing instructions from a memory or transmission source. The aspects or features set forth may be implemented with, as alternatives, and/or in any combination, digital electronic circuitry, hardware, software, firmware, or in analog or direct (such as electromagnetic wave-based, physical wave-based or analog electronic, magnetic or direct transmission, without translation and the attendant degradation, of the medium) systems or circuitry or associational storage and transmission, any of which may be aided with enhancing media from external hardware and software, optionally, by wired or wireless networked connection, such as by LAN, WAN or the many connections forming the internet or local networks. The system can be embodied in a tangibly-stored computer program, as by a machine-readable medium and propagated signal, for execution by a programmable processor. The method steps of the embodiments of the present invention also may be performed by such a programmable processor, executing a program of instructions, operating on input and output, and generating output. A computer program includes instructions for a computer to carry out a particular activity to bring about a particular result, and may be written in any programming language, including compiled and uncompiled, interpreted languages, assembly languages and machine language, and can be deployed in any form, including a complete program, module, component, subroutine, or other suitable routine for a computer program.

I claim:

1. A firearm-mounted ballistic protection system, comprising:

At least one interception media, held in a housing mounted on a firearm, and configured to be launched from said housing;

interception media launching propellant and at least one launching propellant trigger;

computer hardware, configured to control said at least one launching propellant trigger and a microphone or other emanating phenomena sensor mounted on said firearm;

wherein said microphone or other emanating phenomena sensor is mounted on said firearm, at a location forward from said housing, and is wired, or otherwise in communication, with said computer hardware, and is fixed at a distance from said computer hardware; and wherein said computer hardware is capable of performing operations, based in part on said distance and said location, to determine a location and trajectory of a projectile approaching said firearm; and wherein said computer hardware is capable of intercepting said projectile at least in part by triggering said propellant.

2. The firearm-mounted ballistic protection system of claim 1:

wherein said microphone or other emanating phenomena sensor comprises an extension with a first intake horn and a second intake horn, and wherein said first intake horn comprises a media denser than a media comprised in said second intake horn.

3. The firearm-mounted ballistic protection system of claim 1:

wherein said microphone or other emanating phenomena sensor comprises an extension with a first intake horn and a second intake horn, and wherein said first intake horn comprises a media with a different pattern than a media comprised in said second intake horn.

4. The firearm-mounted ballistic protection system of claim 1, further comprising:

a second microphone or other emanating phenomena sensor.

5. The firearm-mounted ballistic protection system of claim 4, further comprising:

a third microphone or other emanating phenomena sensor.

6. The firearm-mounted ballistic protection system of claim 1:

wherein said microphone or other emanating phenomena sensor comprises at least one camera; and wherein said computer hardware is further configured to determine and issue at least one interception execution signal based at least in part on the transmission speed of electromagnetic radiation in space or air, based at least in part on the transmission speed of electricity through wiring, and based at least in part on the speed, or a range of possible speeds, of said projectile.

7. The firearm-mounted ballistic protection system of claim 6:

wherein said computer hardware is configured to compare input from said at least one camera to libraries of images or other recorded expressions of projectiles in flight; and wherein said computer hardware is configured to determine a probable trajectory of said projectile based on said comparing.

8. The firearm-mounted ballistic protection system of claim 7:

wherein said computer hardware is configured to determine an interception timing and path for launching said interception media, based at least in part on said probable trajectory.

9. The firearm-mounted ballistic protection system of claim 1, further comprising:

multiple launching units, each comprising at least one separate propellant and interception media.

10. The firearm-mounted ballistic protection system of claim 9:

wherein said multiple launching units are trained or trainable on different regions of space, to cover different potential projectile trajectories.

11. The firearm-mounted ballistic protection system of claim 9:

wherein said computer hardware selects and/or trains at least one of said multiple launching units based on said trajectory of a projectile approaching said firearm.

12. The firearm-mounted ballistic protection system of claim 1:

wherein said interception media is capable of intercepting said projectile by reducing the kinetic energy of said projectile.

13. The firearm-mounted ballistic protection system of claim 1:

wherein said interception media is capable of intercepting said projectile by diverting the path of said projectile.

14. The firearm-mounted ballistic protection system of claim 1:

wherein said interception media is capable of intercepting said projectile by sequestering said projectile.

15. The firearm-mounted ballistic protection system of claim 1:

wherein said interception media is capable of intercepting said projectile by creating an increased surface area for an impact with a human body.

16. The firearm-mounted ballistic protection system of claim 1:

wherein said interception media comprises attitude-altering surface features.

* * * * *